US010283919B2

(12) United States Patent
Strong

(10) Patent No.: US 10,283,919 B2
(45) Date of Patent: May 7, 2019

(54) RACEWAY WITH CONNECTIVITY RECEPTACLES

(71) Applicant: Clinton Strong, Dallas, TX (US)

(72) Inventor: Clinton Strong, Dallas, TX (US)

( * ) Notice: Subject to any disclaimer, the term of this patent is extended or adjusted under 35 U.S.C. 154(b) by 0 days.

(21) Appl. No.: 15/967,455

(22) Filed: Apr. 30, 2018

(65) Prior Publication Data

US 2018/0248325 A1 Aug. 30, 2018

Related U.S. Application Data

(63) Continuation of application No. 14/776,916, filed as application No. PCT/US2014/026554 on Mar. 14, 2013, now Pat. No. 9,960,554.

(60) Provisional application No. 61/790,949, filed on Mar. 13, 2013.

(51) Int. Cl.

| | |
|---|---|
| ***H01R 4/60*** | (2006.01) |
| ***H01R 25/16*** | (2006.01) |
| ***H01R 31/02*** | (2006.01) |
| ***H01R 24/66*** | (2011.01) |
| ***H01R 24/76*** | (2011.01) |
| ***H01R 27/02*** | (2006.01) |
| ***H01R 43/26*** | (2006.01) |
| *H01R 107/00* | (2006.01) |

(52) U.S. Cl.

CPC ..... *H01R 25/16* (2013.01); *H01R 24/66* (2013.01); *H01R 24/76* (2013.01); *H01R 27/02* (2013.01); *H01R 31/02* (2013.01); *H01R 43/26* (2013.01); *H01R 2107/00* (2013.01)

(58) Field of Classification Search

CPC ..... H01R 25/16; H01R 25/161; H01R 24/66; H01R 24/76; H01R 27/02; H01R 31/02; H01R 43/26; H01R 2107/00

USPC ..... 439/207–215

See application file for complete search history.

(56) References Cited

U.S. PATENT DOCUMENTS

| | | | | |
|---|---|---|---|---|
| 8,172,589 | B2 | 5/2012 | Johnson | |
| 9,960,554 | B2 * | 5/2018 | Strong | H01R 25/16 |
| 2009/0239402 | A1 | 9/2009 | Byrne | |
| 2012/0231668 | A1 | 9/2012 | Byrne | |

OTHER PUBLICATIONS

International Preliminary Report on Patentability for PCT/US2014/026554, dated Aug. 7, 2015 (8 pages).

International Search Report for PCT/US2014/026554, dated Jul. 11, 2014 (3 pages).

Written Opinion of the International Searching Authority for PCT/US2014/026554, dated Jul. 11, 2014 (6 pages).

Miscellaneous Communication regarding International Preliminary Report, dated Sep. 1, 2015.

* cited by examiner

*Primary Examiner* — Khiem Nguyen

(74) *Attorney, Agent, or Firm* — Ferguson Braswell Fraser Kubasta PC; Elizabeth Philip Dahm; Kelly J. Kubasta

(57) ABSTRACT

In various implementations, a raceway system may provide power and/or data connectivity to one or more locations. The raceway system may include modular receptacles. The modular receptacles may include power sockets and/or modular communication sockets.

20 Claims, 9 Drawing Sheets

RACEWAY WITH CONNECTIVITY RECEPTACLES

CROSS-REFERENCE TO RELATED APPLICATION

This application is a continuation of U.S. patent application Ser. No. 14/776,916, entitled "RACEWAY WITH CONNECTIVITY RECEPTACLES", filed on Sep. 15, 2015 and issuing as U.S. Pat. No. 9,960,554 on May 1, 2018, and which is a National Stage Application of International Application No. PCT/US2014/026554, filed on Mar. 13, 2014, which claims priority to U.S. Provisional Patent Application No. 61/790,949, entitled "RACEWAY WITH MODULAR POWER AND COMMUNICATION RECEPTACLES" filed on Mar. 15, 2013, all of which are incorporated by reference herein for all purposes.

TECHNICAL FIELD

The present invention relates to providing connectivity.

BACKGROUND

Power and communications capabilities can be provided to a location (e.g., desks, conference tables, televisions, etc.) in a structure by modifying and/or providing new electrical and communication wiring. Often providing new wiring or modifying existing wiring to a location may include coring through concrete flooring, creating openings in walls, and/or otherwise making modifications to the structure. In addition, as needs change, the wiring may need to be adjusted to accommodate wiring location layout changes, new types of data connectivity, and/or the need for additional connectivity. These changes may include making further modifications to the structure.

SUMMARY

In various implementations, a raceway may be provided that provides connectivity (electrical and/or communications) to a location. In some implementations, the raceway may be coupled to a floor of a structure and provide connectivity to one or more locations proximate the raceway. In some implementations, the raceway may be positioned above a flooring of a structure to provide connectivity (e.g., electrical and/or communication) to one or more locations proximate the raceway. One or more receptacles may be coupled to the raceway and connectivity may be provided through the receptacle to a device coupled (e.g., wirelessly, via Bluetooth, via USB, and/or via Ethernet) to the receptacle. Fixed and/or modular receptacles may be coupled to the raceway. The modular receptacles may provide electrical and/or data connectivity to device(s) via one or more power sockets and one or more modular connectivity sockets.

In some implementations, the modular receptacle may be disposed at least partially in the raceway (e.g., so a face of the receptacle is approximately level with a top surface of raceway. In some implementations, the modular receptacle may be disposed on a surface of the flooring of a structure (e.g., not disposed in the raceway). In some implementations, the modular receptacle may include a vertical housing, which may be coupled to the raceway.

In various implementations, a raceway may be utilized to provide connectivity (e.g., to devices, furniture, and/or equipment, for example, via receptacles. A raceway may include a housing that includes a cavity, cable(s), and two or more connectivity couplers. The cable(s) may be adapted to provide connectivity when the cable(s) are coupled to a connectivity source (e.g., power source and/or communications source). The connectivity couplers may be coupled to at least one of the cables. The connectivity couplers may include a first connectivity coupler and a second connectivity coupler. The first connectivity coupler may provide connectivity to first receptacle(s) coupled to the first connectivity coupler and may be directly coupled to a connectivity source member via the cable(s) of the raceway. The second connectivity coupler may provide connectivity to second receptacle(s) coupled to the second connectivity coupler. The raceway may allow the second connectivity coupler to provide connectivity to the second receptacle(s) coupled to the second connectivity coupler when the first connectivity coupler is not coupled to at least one of the first receptacles.

Implementations may include one or more of the following features. The raceway may allow the second connectivity coupler to provide connectivity to the second receptacle(s) coupled to the second connectivity coupler when the first connectivity coupler is coupled to at least one of the first receptacles. The raceway may include cover(s) disposed over at least a portion of the housing. The first receptacle(s) and the second receptacle(s) may be similar and/or different types of receptacles. For example, the first receptacle(s) and/or the second receptacle(s) may be fixed and/or modular receptacles. The first receptacle(s) and/or the second receptacle(s) may be hard-wired and/or otherwise coupled to the connectivity coupler(s), in some implementations. The raceway may include third connectivity coupler(s) that may provide connectivity to third receptacle(s) coupled to the third connectivity coupler(s). The raceway may allow the third connectivity coupler(s) to provide connectivity to the third receptacle(s) coupled to the third connectivity coupler(s) when other connectivity coupler(s) are not coupled to the receptacles. In some implementations, the raceway may allow the second connectivity coupler to provide connectivity to the second receptacle(s) coupled to the second connectivity coupler when the first connectivity coupler is not coupled to at least one of the first receptacles and when the third connectivity coupler(s) are not coupled to at least one of the third receptacles. The first connectivity coupler may be disposed at a first position proximate a connectivity coupling member on the raceway and the second connectivity coupler may be disposed at a second position along a length of the raceway. A third may be disposed at a third position along the length of the raceway. The second position may be disposed between the first position and the third position. In some implementations, the raceway may allow the third connectivity coupler to provide connectivity to the third receptacle(s) coupled to the third connectivity coupler when the first connectivity coupler is not coupled to at least one of the first receptacles and/or the second connectivity coupler is not coupled to at least one of the second receptacles. The raceway may include at least one cable adapted to provide electrical connectivity and communications connectivity. The raceway may include conduit(s) at least partially disposed in the cavity of the housing, wherein one or more of the cables are at least partially disposed in the conduit(s). The second connectivity coupler may include a first coupling member and the second receptacle(s) may include second coupling member(s). The first coupling member of the second connectivity coupler may couple to the second coupler of at least one of the second receptacles to couple the second connectivity coupler to the second receptacle(s). The housing may include a cable coupling member that may retain at least one cable in the housing.

In various implementations, a raceway, which provides connectivity, may include a housing that includes a cavity. The raceway may include cable(s), which may provide connectivity when coupled to a connectivity source. The cables may include two or more connectivity couplers disposed at fixed locations along a length of a raceway. A connectivity coupler may provide connectivity to receptacle(s) coupled to the connectivity coupler. The raceway may include an electrical power plug, which extends from the housing, and may couple to a power source. At least one of the cables may be coupled to the electrical power plug.

Implementations may include one or more of the following features. The raceway may include cover(s) disposed over at least a portion of the housing. The connectivity couplers may include a first connectivity coupler and a second connectivity coupler. The first connectivity coupler may provide connectivity to one first receptacle(s) coupled to the first connectivity coupler. The first connectivity coupler may be directly coupled to the connectivity source member via at least one of the cables of the raceway. The second connectivity coupler may provide connectivity to second receptacle(s) coupled to the second connectivity coupler. The raceway may allow the second connectivity coupler to provide connectivity to the second receptacle(s) coupled to the second connectivity coupler when the first connectivity coupler is not coupled to at least one of the first receptacles. The raceway may include a communication plug, which extends from the housing, and may be coupled to a communications connectivity source. At least one of the cables may be coupled to the communication connectivity plug. In some implementations, the connectivity coupler(s) may be coupled to more than one cable. The raceway may include receptacle(s) that may couple to the connectivity coupler(s).

In various implementations, a raceway may be coupled to one or more connectivity sources. The raceway may include two or more connectivity couplers to provide connectivity to one or more receptacles coupled to at least one of the connectivity couplers. The connectivity coupler(s) may include a first connectivity coupler directly coupled to a connectivity source and a second connectivity coupler. Connectivity may be provided to a first receptacle coupled to the second connectivity coupler when the first connectivity source is not coupled to another receptacle.

Implementations may include one or more of the following features. A cover of the raceway may be removed such that access to a first portion of a cavity of a housing of the raceway is allowed. A second receptacle may be coupled to at least one of the connectivity couplers accessible through the first portion of the cavity. In some implementations, a first receptacle coupled to the second connectivity coupler of the raceway may be uncoupled, and a cover may be disposed over the second connectivity coupler. The connectivity couplers may include third connectivity coupler(s). Connectivity may be provided to third receptacle(s) by coupling at least one of the third receptacles to the third connectivity coupler(s). The third connectivity couplers may be allowed to provide connectivity to the third receptacle(s) coupled to at least one of the third connectivity couplers when the first connectivity coupler is not coupled to another receptacle and/or when the second connectivity coupler is not coupled to at least one of the first receptacles. In some implementations, the raceway may be coupled to a connectivity source via a connectivity source member, which may extend from the housing of the raceway and may be coupled to the cable(s) of the raceway.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of the present disclosure and its features, reference is now made to the following description, taken in conjunction with the accompanying drawings, in which.

Like references in the various drawings may indicate like elements.

DETAILED DESCRIPTION

Figure 1A:
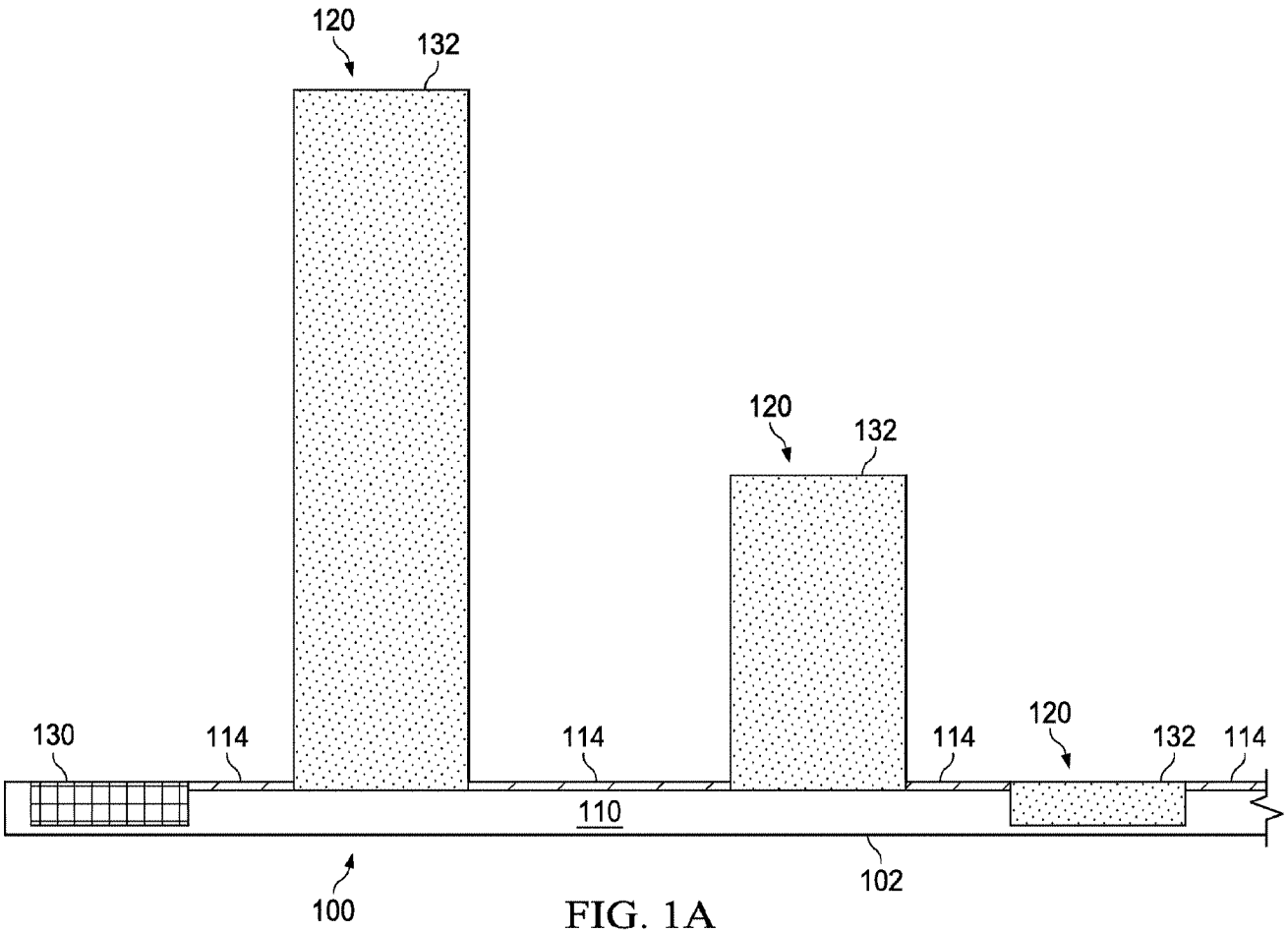
FIG. 1A illustrates a cutaway view of an implementation of an example portion of a raceway system.

In various systems and processes, connectivity, such as power and data connectivity, may be provided to one or more locations (e.g., in a structure and/or outdoors) temporarily and/or permanently using a raceway system. The raceway system or raceway may include a housing in which conduit(s) may be at least partially disposed. A conduit may provide electrical (e.g., power), communication (e.g., data, telephone, video, etc.), and/or other types of connectivity via one or more cables disposed in the conduit. In some implementations, one end, for example, of the raceway may be coupled to a connectivity source (e.g., power source and/or source of communications connectivity). For example, the raceway may be coupled to power lines, Ethernet lines, fiber optic lines, and/or other types of lines in a wall of a structure, for example. In various implementations, receptacle(s) may be coupled to the raceway such that connectivity may be provided by the raceway to the receptacle(s) independent of whether other receptacle(s) are coupled or uncoupled to other locations on the raceway.

The raceway may be installed in a location (e.g., a building, a park, and/or other locations) to provide connectivity proximate the raceway. For example, the raceway may be installed on a floor (e.g., inside a building and/or outside a building), on a wall, and/or a ceiling.

In some implementations, the raceway may be capable of providing connectivity at fixed locations along the raceway. For example, the raceway may include connectivity couplers that allow connectivity to be provided to receptacles and/or other devices coupled to the raceway. The raceway may allow a connectivity coupler to provide connectivity to a receptacle coupled to the receptacle even when other connectivity couplers are not coupled to other receptacles. In some implementations, one or more of the connectivity couplers may not be inhibited from providing connectivity to a receptacle coupled to the connectivity coupler(s) when one or more other connectivity couplers are not coupled to a receptacle. For example, unlike some systems in which all locations must be connected to provide connectivity to any one or more of the receptacles, the described raceway may provide flexibility (e.g., in the locations to which connectivity is provided) and/or reduce costs (e.g., since receptacle(s) not utilized may be removed and/or not included in a raceway while the raceway may remain in place).

In various implementations, the raceway may be positioned on a location, such as on top of a subfloor and/or on top of flooring. The raceway may include cable(s), which include connectivity couplers disposed along a length of the cable. The cable(s) may have any appropriate length. The cable(s) may be approximately the same or a different length as the length of the housing. For example, cable(s) may extend approximately the length of the raceway housing. Cables may be disposed in the raceway (e.g., in one or more cavities of the raceway) and each of the connectivity couplers may be coupled to one or more of the cables of the raceway. For example, a continuous conduit may house the cable(s) and receptacle(s) may extend from the conduit. Receptacle(s) may be coupled to the connectivity coupler(s). Since the raceway is flexible, as needed, the receptacles may be removed, replaced, and/or more receptacles may be added to the raceway (e.g., by coupling the receptacle(s) to connectivity coupler(s) and/or other coupled receptacle(s)).

In some implementations, the use and/or the layout of a location, such as an open concept office, a library, a conference center, a meeting hall, a school, and/or other locations, may change and thus, by utilizing a raceway the locations along the raceway at which connectivity is provided may be altered. The ability to alter the locations at which connectivity is provided may allow a single raceway to be used and/or adapted for use during a variety of changes in a location. For example, when a conference center hall includes furniture such as rows of benches or desks, a first configuration of a raceway may be utilized. Furniture may be coupled to one or more connectivity couplers of the raceway. When the use of the conference center hall changes, such as to a dance hall, the furniture may be uncoupled and covers may be placed over the previously used connectivity couplers. When the use of a conference center hall changes, for example, to a trade show, the connectivity couplers may be coupled to kiosks and/or receptacle(s) (e.g., modular receptacle(s) such as towers and/or approximately flush mounted receptacle(s)) to provide connectivity to user devices proximate a kiosk.

In some implementations, a location may be utilized for a plurality of temporary purposes (e.g., meeting spaces, retail spaces such as pop up shops, and/or office conference rooms). Utilizing one or more raceways may provide flexible connectivity configurations for the location. For example, a multi-purpose room may be reconfigured based on, for example, use. When the room is utilized for training, the room may arranged in a first configuration, such as with tables arranged in rows, conference table(s), and/or chairs in rows. The raceway may be configured (e.g., receptacles may be coupled and/or uncoupled from one or more locations on the raceway, for example via a connectivity coupler; types of receptacles utilized may be adjusted; and/or number of receptacles may be adjusted) based at least partially on the first configuration. As the use of the multipurpose room changes, a different second configuration of the room (e.g., from the first configuration) may be utilized. Thus, the configuration of the raceway (e.g., the coupling of the receptacles to the raceway and/or other receptacles coupled to the raceway; and/or the coupling of the cover(s) to the housing) may be adjusted based at least partially on the second configuration. While the raceway housing may be maintained (e.g., may remain in place at a location), the configuration of the housing may be adjusted to accommodate various applications, uses, and/or changes in technology.

In some implementations, a raceway may be utilized in a location, such as a library, and the room may change based on use and/or based on technology demands. For example, when a room is used as study space, rows of desks may be coupled to raceway(s). When a room is used as a reading room, receptacles to provide connectivity proximate seating may be utilized with the raceway.

In some implementations, a raceway may be utilized in a location such as an open office environment. The arrangement of furniture, seating, equipment and/or people may change based on the use of portions of the open office environment. As the environment changes, the raceway may be adjusted (e.g., number, type, and/or location of receptacles coupled to the raceway may be adjusted; the coupling of the receptacles to the raceway and/or other receptacles coupled to the raceway; and/or the coupling of the cover(s) to the housing) based on the use.

In some implementations, a raceway may be utilized in a cafeteria (corporate, educational, etc.). In a cafeteria, tables and lounging sections (e.g., chairs and/or sofas) may be utilized and the raceway may allow connectivity to both types of sections.

In some implementations, a raceway may be utilized in airports (e.g., boarding areas, lounges, and/or dining areas). Since the traffic in airports vary (e.g., based on time of year, time of day, and/or services provided at specific locations), the raceway (e.g., the coupling of the receptacles to the raceway and/or other receptacles coupled to the raceway; and/or the coupling of the cover(s) to the housing) may be adjusted to accommodate changes in traffic and/or use of spaces in airports. For example, extra kiosks may be provided for airline use during the winter to handle weather delays and flight changes. Thus, during the winter the raceway may be utilized to provide connectivity to the furniture (e.g., desk outlets) of the kiosk, for example. In other seasons, the area may be rededicated to lounge area and receptacles (e.g., towers, modular and/or fixed receptacles to provide power, Ethernet, and/or Wi-Fi connections) for flyers awaiting flights may be coupled to the raceway.

In some implementations, a plurality of raceways may be positioned in a first configuration (e.g., rows, latticed, about a periphery, and/or other arrangements) in a location such as a room, area, or other space. Then, as the location is used for a space, receptacle(s) may be coupled, uncoupled, and/or replaced based on the use. In some implementations, repairs and/or maintenance may be facilitated since receptacle(s) may be replaced rather than repaired in place or replacing the entire raceway.

By allowing the raceway to be adjusted (e.g., number, type, and/or location of receptacles may be adjusted), the use of a space may be enhanced (e.g., since a space can accommodate changes in use and/or technology demands); traffic flow may be improved when compared with systems that include fixed receptacles (e.g., since the cover of the raceway may be at approximately the same height as flooring, since the raceway may include sloped sides to inhibit tripping, and/or since the cover of the raceway may be within a predetermined trip height of the top surface of the flooring); and/or ease of use of the raceway may be improved (e.g., when compared to a system that must be removed and replaced to provide a new arrangement of receptacles or different types and/or numbers of receptacles). In some implementations, the adjustability of the raceway may facilitate adjustments based on changes in technologies (e.g., new data connectivity connectors, new power plugs, increased use of a device when compared with previous usage). In addition, the cost of a raceway over the lifetime of the raceway and/or the location may be decreased (e.g., when compared with conventional power arrangements) since the raceway may be adjusted to accommodate repairs, replacements, new technology needs, and/or new location usages.

The raceway may be designed such that a top surface of the raceway or portion thereof is at approximately the same height as installed flooring (e.g., the raceway may be installed at least partially under flooring). For example, a top surface of the raceway may be less than approximately 1 inch higher than a top surface of flooring installed at a location (e.g., inside a building or outside a building). In some implementations, the raceway may be installed in a location above existing flooring. The sides of the raceway may be angled to reduce trip hazards, in some implementations. Examples of raceways are described in U.S. Pat. No. 6,566,598 filed on Apr. 10, 1997 and U.S. Pat. No. 6,844,493 filed on May 19, 2003, which are both hereby incorporated by reference to the extent that the disclosures do not conflict with the described systems and processes. For example, housings or portions thereof similar to the housings described in U.S. Pat. No. 6,566,598 and U.S. Pat. No. 6,844,493 may be utilized with one or more of the raceways described herein.

Figure 1B:
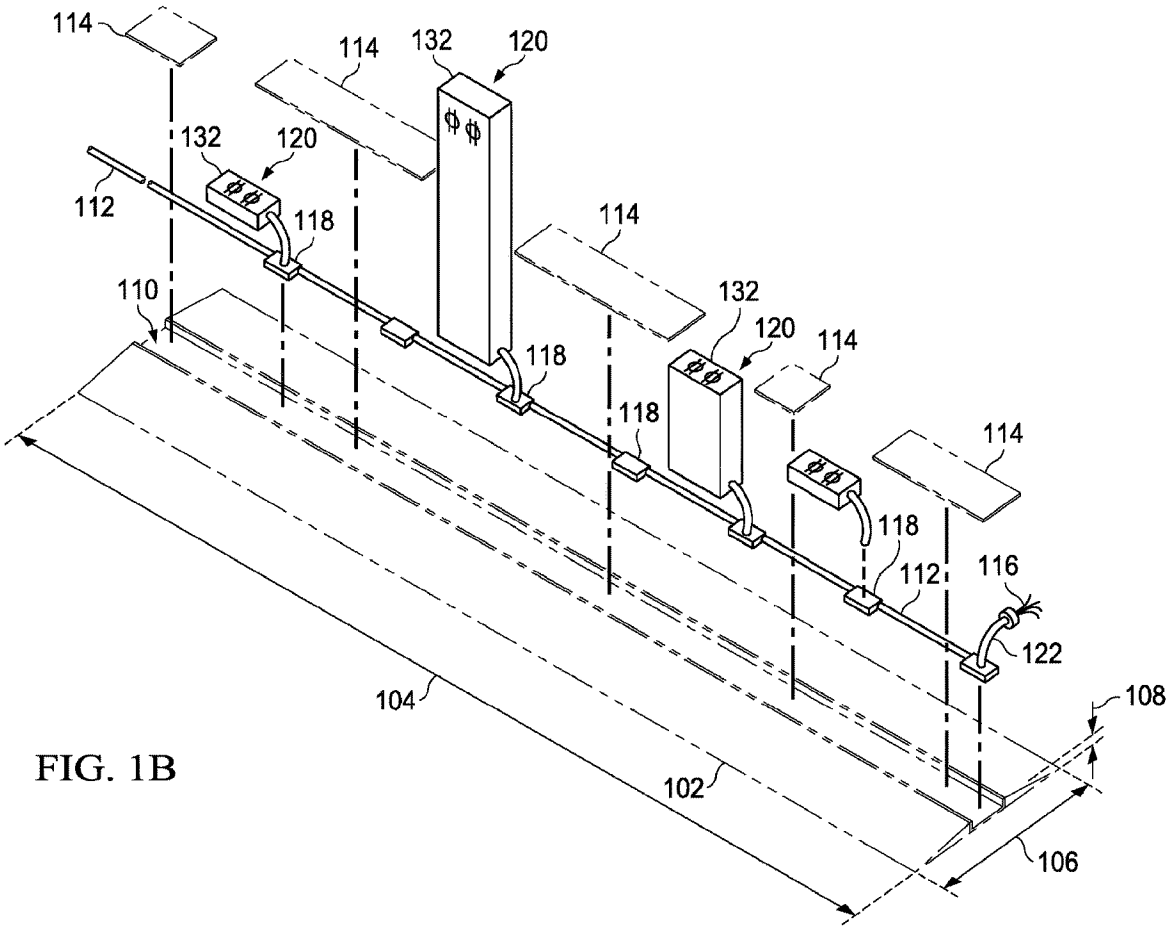
FIG. 1B illustrates an exploded view of an implementation of an example raceway system.
Figure 1C:
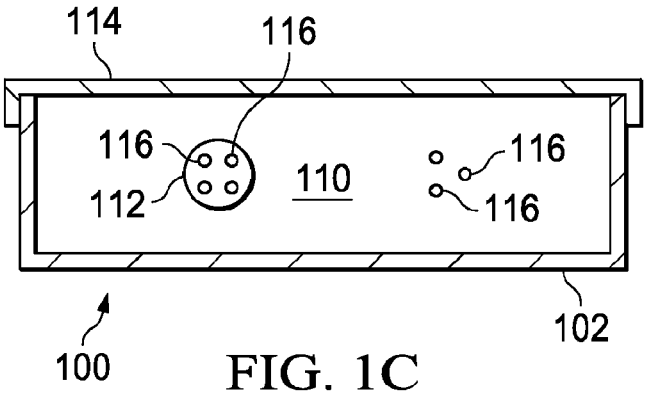
FIG. 1C illustrates a cross-sectional view of implementation of an example portion of a raceway system.

FIG. 1A illustrates a cutaway view of an implementation of an example portion of a raceway 100. FIG. 1B illustrates an exploded view of an implementation of an example raceway 100. FIG. 1C illustrates a cross-sectional view of an implementation of an example portion of a raceway 100.

The raceway 100 may provide connectivity (e.g., power, communication, and/or other types of connectivity) to one or more locations proximate the raceway. For example, the raceway may include one or more fixed positions at which connectivity may be provided to receptacle(s) and/or device(s) (e.g., furniture).

The raceway 100 may include a housing 102. The housing 102 may include plastic, metal, rubber, reinforcement (e.g., carbon and/or fiberglass fibers), and/or any other appropriate material. In some implementations, the housing or portions thereof may be water-resistant and/or water-proof. For example, in outdoor, wet room, and/or other applications, the raceway may be at least partially water-proof to satisfy codes (e.g., government, industry and/or company standards). The housing 102 may have a strength such that when people walk on, people walk over, and/or equipment rolls over the housing, the housing is not substantially deformed. For example, the housing may have elastic flexibility such that deformation that occurs when a person walks on at least a portion of the housing is substantially reduced once the person steps, for example, off the raceway. In some implementations, the housing may have a strength that allows a live load of at least approximately 100 psf.

The housing 102 may include any appropriate shape and/or size. For example, a housing may have an approximately rectangular cross-sectional shape, approximately square cross-sectional shape, an approximately trapezoidal cross-sectional shape, and/or any other appropriate regular or irregular cross-sectional shape.

The housing 102 may have dimensions, such as a length 104, a width 106, and a height 108. The dimensions of the housing 102 may be selected based on the application of the raceway 100 and/or the components (e.g., cables and/or connectivity couplers) to be included in one or more cavities of the raceway. For example, a length 104 of the housing 102 may be based at least partially on a length of a room in which the raceway 100 will be installed. A width 106 of a housing 102 may be based on the type and/or size of cables, which will be housed in the housing, and/or based on the type of receptacles, which will be coupled to the housing. In some implementations, the height 108 of the housing 102 may be based at least partially on the height of the flooring to be used in a location in which the raceway 100 will be installed (e.g., such that the top surface of the housing is approximately the same as the top surface of the flooring and/or such that the top surface of the housing is approximately within a predetermined trip tolerance, such as 1 inch, of the top surface of the flooring).

The housing 102 may include one or more cavities 110. At least a portion of the cavity may be shaped such that the portion couples with covers, receptacles, and/or portions thereof. As illustrated, the housing 102 may include a cavity in which one or more conduits 112 reside. In some implementations, the housing 102 may include more than one cavity 110. For example, a first cavity may include one or more first conduits and a second cavity may include one or more second conduits. The first conduit(s) and the second conduit(s) may be similar or different (e.g., in size, type, number, and/or contents such as types of cables included.).

The cavity 110 may include any appropriate cross-sectional shape. The cavity may have any appropriate shape, such as a U-shaped opening in the top surface of the housing. The cavity may include recess(es) and/or protrusion(s). For example, the cavity may include one or more recesses disposed in a top surface of the housing along at least a portion of a length of the housing. The cavity may include a channel, in some implementations. A housing may include a cavity that extends along a length of the housing. For example, a cavity may extend from proximate a first end of the housing to proximate a second end of the housing. A housing may include more than one cavity disposed at locations along a length of the housing, in some implementations.

The housing may include one or more covers 114. The cover may include a material similar or dissimilar to other portions of the housing. A cover may have a strength such that when people and/or equipment travel (e.g., walk or roll) over and/or on the cover and/or housing, the cover and/or the housing are not substantially deformed. The cover may be configured to reside over at least a portion of the cavity of the housing. A cover may be removable or fixed. When a cover is removed, access to the cavity and/or components (e.g., connectivity couplers, conduit, and/or cables) may be provided. The cover(s) 114 may couple with a portion of the housing 102 (e.g., lower portion), in some implementations. For example, a cover 114 may snap (e.g., via a cover coupling member) into a portion of a housing 102 (e.g., a cover coupling member of a housing), may be disposed in one or more recesses of a housing, may be positioned in a track of the housing, etc. In some implementations, fasteners (e.g., screws, bolts, clips) may be utilized to couple the cover 114 to the housing 102.

A cover 114 may be positionable over at least a portion of a cavity 110 of a housing 112. Cover(s) 114 utilized in a raceway 100 may be of similar and/or dissimilar lengths. In some implementations, a length of a cover 114 may be adjustable (e.g., the cover may include material that may be cut by a user and/or the cover may include perforations along which the cover may be broken, cut and/or otherwise trimmed).

A cover 114 may be may be selected to be flush with a flooring in an installation area, in some implementations. A cover 114 may be selected to inhibit tripping (e.g., a cover may form a planar surface and/or a surface that is elevated within a trip tolerance range of flooring and/or a top surface of the housing of the raceway).

A cover 114 and/or the housing 102 may include indicia (e.g., to identify a walkway, to identify emergency exits, to identify trip hazards, and/or other types of indicia). A cover 114 and/or a housing 102 of the raceway may include lighting, in some implementations.

One or more conduits 112 may be disposed at least partially in the housing 102, for example, at least partially in a cavity 110 of the housing. A conduit 112 may include one or more cables 116. For example, one or more cables 116 may be disposed at least partially in the conduit 112. A conduit may provide protection for cable(s) disposed at least partially in the cavity of the conduit and/or satisfy code (e.g., government, industry, and/or company) requirements in an application. For example, the conduit may be at least partially static resistant, fire resistant, abrasion resistant, and/or water resistant.

Cables may include any appropriate cable. For example, cables may include power cables, communication cables, etc. For example, the cables may include power cords, CAT 5 cables, CAT 6 cables, phone cables, coaxial cable, fiber optic, etc. In some implementations, a conduit 112 may be a cable 116. For example, a single cable may be utilized as a conduit to provide power and communications connectivity, in some implementations.

Figure 1D:
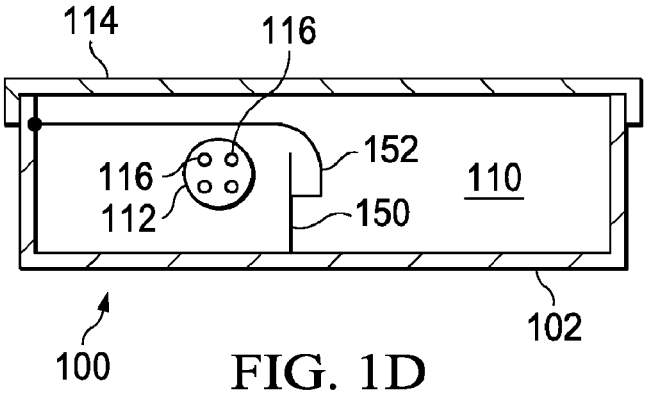
FIG. 1D illustrates a cross-sectional view of implementation of an example portion of a raceway system.
Figure 1E:
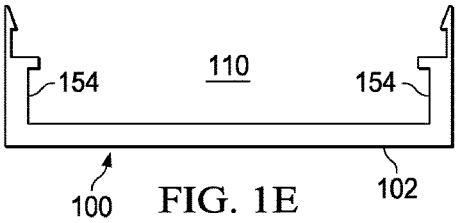
FIG. 1E illustrates a cross-sectional view of implementation of an example portion of a raceway system.

As illustrated in FIG. 1C, the conduit 112 and/or the cables 116 may be disposed in a cavity 110 of the housing 102 and may be retained by the cover 114 in the housing. In some implementations, the conduit 112 and/or the cable may be retained in the housing of the raceway. For example, the housing may include cable coupling members, such as recess(es), loop(s), tie(s) or other fastener(s), and/or other types of appropriate coupling members. As illustrated in the implementation of an example installation 180 in FIG. 1D, the housing may include a cable coupling member such as a protrusion 150 and/or a fastener 152 (e.g., a tie). As illustrated in the implementation of an example installation 180 in FIG. 1E, the housing 102 may include a cable coupling member such as a recess 154, to retain a cable and/or receptacle in the housing. For example, a cable may be retained by the recess 154 and/or a housing of a receptacle may include a portion that is adapted to be received by the recess.

The cable(s) 116 may provide connectivity, such as power connectivity and/or communication connectivity. For example, a cable may include one or more power cables (e.g., 110 V, 220V, 240V alternating current, direct current, and/or any other appropriate voltage, current, and/or power rating). A cable may include a phone line. A cable may include internet accessibility (e.g., CAT5, Ethernet line, and/or fiber optic line). In some implementations, a cable may provide power and/or cable connectivity (e.g., power line communication systems or power over Ethernet lines, such as using CAT 5 cables and/or CAT 6 cables). The cable 116 may allow secure and/or unsecure communications with one or more other components, such as repositories (e.g., local and/or remote), computer systems, etc.

The raceway 100 may include one or more connectivity couplers 118. A raceway may include more than one fixed location at which connectivity may be provided. For example, a raceway may include a plurality of connectivity couplers disposed across a length of the raceway, conduit, and/or cable at fixed locations. A connectivity coupler may be located on and/or coupled to the conduit and/or cable proximate the locations.

In some implementations, the raceway 100 may include more than one connectivity couplers. The connectivity couplers may be coupled to the conduit and/or cables to provide the connectivity provided by the cable to receptacle(s) coupled to the connectivity coupler(s). For example, a first power cable in a conduit may be coupled to a first connectivity coupler. When a first receptacle is coupled to the first connectivity coupler, the first power cable may be able to provide power connectivity (e.g., via the first connectivity coupler) to devices (e.g., laptops, phones, lights, furniture, etc.) coupled to the first receptacle. In some implementations, a second data cable (e.g., Ethernet, fiber optic, and/or phone line) may be coupled to the first connectivity coupler and/or a different connectivity coupler. When the first receptacle is coupled to the first connectivity coupler and/or other connectivity coupler, data connectivity may be provided via one or more sockets in the first receptacle to a device, furniture, and/or equipment, for example.

The connectivity couplers may be coupled to the conduit and/or cables using any appropriate coupling. For example, connectivity couplers may be coupled using a hardwire connection to the cable and/or conduit. Connectivity couplers may be coupled via twisted pair coupling and/or other appropriate couplings. In some implementations, the location of a connectivity coupler along a length of conduit and/or cable may not be adjustable.

In various implementations, the connectivity couplers may be coupled to the conduit and/or cable such that a connectivity coupler may not be inhibited from providing connectivity (e.g., electrical and/or communication connectivity) to a receptacle when another connectivity coupler of the raceway is not coupled to a receptacle. Thus, for example, if a raceway has plurality of connectivity couplers and one or more first connectivity couplers are not coupled to first receptacle(s), one or more second connectivity couplers that are coupled to one or more second receptacles may not be restricted from providing connectivity to the second receptacle(s).

In some implementations, the connectivity couplers may be coupled to the conduit and/or cable such that restriction of connectivity to coupled receptacles is inhibited when one or more connectivity couplers is not coupled to receptacle(s). For example, as opposed to power systems in which an electrical and/or communication circuit is broken by the absence of coupling of a receptacle and cable, the raceway described may provide connectivity to a receptacle coupled to any of the connectivity coupler disposed along a raceway independent of whether other connectivity couplers of a raceway are coupled or uncoupled to other receptacles.

For example, a raceway may include at least a first connectivity coupler and a second connectivity coupler. The first connectivity coupler may be directly coupled (e.g., via a cable of the raceway) to a connectivity source. For example, a cable may be coupled at a first end to a connectivity source (e.g., via a connectivity source member and/or connectivity source coupling member, such as a plug and a socket and/or a hardwire connection). As the cable extends away from the connectivity source, the first connectivity coupling that the cable is coupled to may be the first connectivity coupler, and thus the first connectivity coupler may be directly coupled to the connectivity source.

One or more of the other connectivity couplers may be coupled to the connectivity source indirectly. For example, as the cable extends away from the first connectivity coupler, the cable may be coupled to the second connectivity coupler. The cable may provide connectivity (e.g., when coupled to a connectivity source) for the second connectivity coupler to transmit to coupled receptacle(s). A third connectivity coupler may be coupled to the cable at a position farther away from the connection source than the first and second coupling members, in some implementations.

The raceway may allow one or more of the connectivity couplers to provide connectivity to receptacle(s) coupled to the connectivity coupler(s) independently of whether other connectivity couplers are also coupled to receptacle(s). For example, the second connectivity coupler may be allowed to provide connectivity to second receptacle(s) coupled to the second connectivity coupler when the first connectivity coupler and/or the third connectivity coupler is or is not coupled to at least one receptacle. Thus, if a first receptacle is uncoupled from a first connectivity coupler such that the first connectivity coupler is not coupled to at least one receptacle, the second connectivity coupler may still provide connectivity to second receptacles coupled to the second connectivity. The third connectivity coupler may be allowed to provide connectivity to third receptacle(s) coupled to the third connectivity coupler when the first connectivity coupler and/or the second connectivity coupler is or is not coupled to at least one receptacle.

By allowing the connectivity couplers of a raceway to not be inhibited from providing connectivity when other connectivity couplers (e.g., a first connectivity couplers, other connectivity couplers disposed sequentially along a cable closer to the connectivity source, and/or other connectivity couplers) are or are not coupled to a receptacle, the raceway may provide flexibility of use and lower cost (e.g., when compared with system with a fixed number of receptacles hardwired to the cable). For example, by allowing the flexibility in the raceway, receptacles may be added and/or removed based on need in an application. In some implementations, costs may be decreased since the raceway may be customized to the application rather than utilizing a device with a fixed number of receptacles hardwired to the cable.

The connectivity couplers 118 may be coupled along a length of the raceway 100. The distance between the connectivity couplers 118 may be vary or be approximately the same among a plurality of connectivity couplers. For example, four or more connectivity couplers may be spaced approximately equidistant from each other along a length or portion of a length of a raceway. The connectivity couplers 118 may reside at least partially in a cavity of a raceway. In some implementations, a connectivity coupler 118 may reside below a cover of a raceway when a cover is disposed above at least a portion of the connectivity coupler.

The connectivity couplers 118 may be coupleable to one or more receptacles 120. A receptacle may include a coupling member that allows a user to couple a device to the socket(s) of receptacle to provide connectivity to a device (e.g., furniture, projectors, screens, and/or computers). For example, receptacle(s) may include a member with power sockets to provide power to laptops and/or furniture. The receptacles may be fixed receptacles 130 and/or modular receptacles 132. When a connectivity coupler is coupled to a receptacle, the connectivity of cable(s) coupled to the connectivity coupler may be provided to the receptacle (e.g., sockets of the receptacles). The connectivity coupler may be coupled to one or more receptacles using any appropriate coupling. The connectivity coupler may include a first coupling member and the receptacle may include a second coupling member. The second coupling member may be adapted to coupled with the first coupling member to allow the receptacle and the connectivity coupler to be coupled together. For example, the first coupling member of the connectivity coupler may include first a pin and/or socket connection and the second coupling member may include a second pin and/or socket connection that is coupleable with the first pin and/or socket connection. When the two pin and/or socket connections are coupled (e.g., the first pin and/or socket connection is coupled to the second pin and/or socket connection), then the connectivity coupler and the receptacle may be coupled. In some implementations, the connectivity coupler and the receptacle may couple via twisted pair, hardwire connection, spliced connection, and/or quick connect coupling, such as pin and socket connection (e.g., Molex connectors, lightening connectors, and/or USB connectors); recesses and/or protrusions; tracks; fasteners; other cable connectors, and/or other appropriate couplings. In some implementations, a tool (e.g., screwdriver) may not be required to couple a receptacle to a connectivity coupler.

In some implementations, one or more receptacles 120 may be coupled to the raceway 100 via one or more connectivity couplers 118. The receptacles 120 may be hardwired to cables in the raceway, in some implementations. A receptacle 120 may include one or more sockets through which connectivity may be provided to a device coupled to the receptacle via a socket. For example, a receptacle may include a power socket. When a plug of a device, such as furniture and/or a computer, is coupled with the power socket, power may be provided to the device (e.g., when the receptacle is coupled to a power cable, for example via a connectivity coupler).

A receptacle may be fixed and/or modular. For example, a number of sockets type(s) of sockets, and/or configuration of sockets on a modular receptacle may be adjusted. In a fixed receptacle, adjustment of a number of sockets, type of sockets, and configuration of sockets may be restricted.

In some implementations, when a receptacle is to be coupled to the raceway, a cover may be removed from a portion of the raceway to reveal an opening. The opening may include at least a portion of a cavity of the raceway and/or one or more connectivity couplers. The receptacle may be coupled to a connectivity coupler accessible via the opening. For example, when the cover is removed from a portion of the raceway a connectivity coupler may reside in this portion of the raceway. In some implementations, the conduit may be manipulated (e.g., pulled and/or pushed) such that a connectivity coupler may be accessed through the opening produced when the cover is removed. In some implementations, when the receptacle is coupled to the raceway, a top surface of the receptacle may be at approximately the same height from a top surface of flooring as the cover. In some implementations, when the receptacle is coupled to the raceway, a distance between a top surface of the receptacle and a top surface of the cover may be less than 1 inch. In some implementations, the receptacle may include a tower. A tower height may exceed the height between the top surface of a cover and a top surface of a flooring.

Figure 1F:
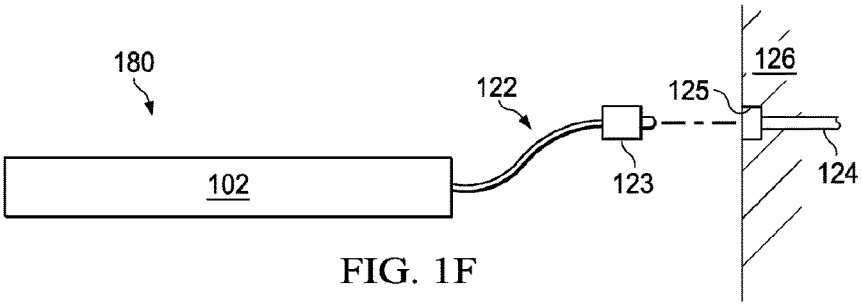
FIG. 1F illustrates a side view of an implementation of an example portion of a raceway system.
Figure 1G:
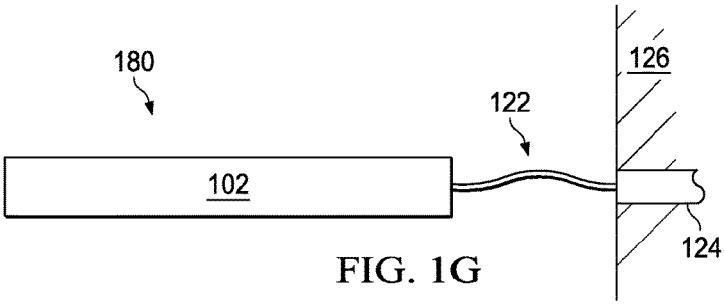
FIG. 1G illustrates a side view of an implementation of an example portion of a raceway system.

The raceway may include a connectivity source member 122. The connectivity source member 122 may couple to a connectivity source 124 (e.g., electrical lines and/or data lines in a structure) to allow the raceway 100 to provide connectivity. As illustrated in FIG. 1F, in some implementations, the connectivity source member 122 may include a plug 123. The plug 123 may coupled to a socket 125 of a connectivity source 124 to allow the raceway 100 to provide connectivity. For example, the plug of the raceway may be coupled to a power socket in a wall. Thus, power may be transmitted via the plug to the cables in the raceway to provide power to receptacles coupled to the raceway. In some implementations, the plug of the raceway may be coupled to an Ethernet jack and/or power socket. The data connectivity may then be transmitted via the plug to the cables in the raceway to provide data connectivity and/or power to receptacles coupled to the raceway 100. In some implementations, as illustrated in FIG. 1G, the connectivity source member 122 may include one or more cables 116 that are coupled to connectivity source 124, such as cables in a structure 126 (e.g., power lines in a wall, power lines in an underground line, etc.).

Although FIGS. 1A, 1B, and 1C illustrate implementations of a raceway other implementations may be utilized. For example, a raceway may include receptacles that are similar or dissimilar from each other. A raceway may include a fixed number of connectivity couplers. The raceway connectivity couplers may be equidistant and/or at different distances from other connectivity couplers.

During use, the raceway may be installed at a location (e.g., inside and/or outside a building). For example, the raceway may be installed on a floor, on a flooring substrate, on a wall, on a ceiling, indoor, outdoor, in furniture, on furniture, in equipment and/or on equipment. Allowing the raceway to be installed on top of an existing base, such as a flooring substrate and/or wall, may decrease installation costs and/or facilitate installation. The housing of the raceway may be coupled to a surface of the location (e.g., floor). The housing may include a cavity in which resides conduit to provide connectivity. The conduit may include a plurality of connectivity couplers disposed along a length of the raceway. The connectivity couplers may be coupled to one or more cables of the conduit and be accessible from the cavity of the housing. The conduit may be disposed in the housing of the raceway prior to, during, and/or after installation of the housing at a location. The raceway may include one or more covers over the cavity of the housing. The cover(s) may coupled to the housing prior to, during, and/or after installation of the housing at a location. One or more receptacles may be coupled to one or more of the connectivity couplers of the raceway. For example, a receptacle may utilize quick connect couplers (e.g., Molex connectors and/or other pin and socket connectors) to couple to the connectivity couplers of the raceway. Restricting the connectivity of the first receptacle(s) may be inhibited if another connectivity coupler is not coupled to a second receptacle. One or more second receptacle(s) may be coupled to the raceway via second connectivity couplers. One or more covers may be removed (e.g., uncoupled) such that at least a portion of the cavity and/or one or more connectivity couplers of the raceway are accessible, prior to coupling a receptacle to the raceway. When the cover has been removed, the first and/or the second receptacle(s) may be coupled to one or more connectivity couplers accessible through the opening. In some implementations, the cover, a portion thereof and/or a new cover may be disposed over at least a portion of the cavity. In some implementations, the receptacle may cover at least a portion of the cavity that was exposed when a cover was removed such that a cover may not be repositioned over the portion of the cavity.

In some implementations, the raceway may be at a first configuration. To change the configuration of the raceway, in some implementations, one or more receptacles may be removed and/or added. For example, one or more receptacles may be uncoupled from the raceway (e.g., a coupling member of a receptacle may be uncoupled from a connectivity coupler of the raceway). The uncoupled receptacle(s) may be replaced by cover(s) and/or different receptacle(s). In some implementations, to alter a configuration of a raceway, a configuration of a modular receptacle may be modified. For example, one or more sockets of the modular receptacle may be removed, replaced, and/or added.

In some implementations, the raceway may include a housing in which cables, such as power cable(s) and/or communications cable(s) are at least partially disposed. The housing may have any appropriate shape and/or size. The housing may include a cavity formed by an opening and/or recess on a surface of the housing (e.g., an open top face and/or a housing with a c-shaped cross-section). The cavity may facilitate access to conduits and/or cables disposed at least partially in the housing of the raceway and/or to allow one or more receptacles to be coupled to one or more of the cables disposed at least partially in the raceway. The housing may include one or more covers that are configured to at least partially cover at least a portion of the opening and/or recess of the housing. For example, cover(s) may be provided in pre-set lengths and multiple cover(s) may be utilized to provide the raceway system appropriate for the location.

In some implementations, the raceway system may include one or more receptacles coupled to the raceway. Receptacle(s) may include a housing of any appropriate shape and/or size. For example, a receptacle housing may be approximately planar on a portion of a top surface and/or may include sloped side(s) (e.g., to inhibit tripping). The receptacle(s) may include towers and/or receptacle(s) that are capable of residing at least partially in the cavity of the housing of the raceway such that a top surface of the receptacle may be at a similar height from a top surface of the flooring as the top surface of the cover and/or housing of the raceway. The receptacles may couple to the raceway (e.g., a housing of the raceway via a track and/or frictional fitting portion of the housing and/or cables of the raceway via, for example, connectivity couplers) using fasteners, recesses, frictional fittings, quick connect couplers, hardwire connections, twisted pairs, and/or any appropriate coupling. When a receptacle (e.g., modular and/or fixed) is coupled to the raceway, power and/or communications connectivity from the cables in the raceway may be provided to the receptacle and/or sockets of the receptacle.

A receptacle may include sockets, such as power sockets and/or communications sockets. The sockets may include a connector that is capable of coupling with a coupling member of a device, such as furniture (e.g., desks, benches, tables), computers, smart phones, tablets, projectors, televisions, monitors, smart boards, speakers, and/or any other appropriate device. For example, a data port of a device and a socket may be coupled via an Ethernet line. A power plug of a device may be coupled to a socket, in some implementations.

In some implementations, receptacles may include fixed receptacles and/or modular receptacles. The fixed and/or modular receptacles may be coupled to the raceway via connectivity couplers in any appropriate manner. For example, the receptacle(s) may be hard-wired, quick coupled (e.g., via connectors, such as CAT6 connectors, fiber optic connectors, etc.) and/or other wise coupled to the connectivity coupler(s). A fixed receptacle may include a predetermined number and/or type of sockets. For example, a fixed receptacle may include two power sockets and two communication sockets, such as Ethernet ports. Fixed receptacles may include, but are not limited to, one or more of the following:

- A single receptacle unit may be installed at a location on the raceway, for example, at or near the end of the raceway (e.g., opposite the wall and/or the column). This device may provide two or four electrical outlets plus any fixed number and/or fixed type of telecommunications connector (e.g., for phones, computers, etc.), for example. This receptacle unit may be hard-wired to an incoming flexible steel power conduit and/or coupled to a cable of the raceway via a connectivity coupler.
- A single junction box unit may be installed, for example, at or near the end of the raceway (e.g., opposite the wall or column). This junction box may be hard-wired and/or coupled via connectivity coupler(s) to a flexible steel power conduit of the raceway. Furniture system or equipment power conduits may be hard-wired and/or otherwise coupled (e.g., plugged and/or quick connected) to this junction box. In addition, telecommunications cables, which pass through the raceway, may exit via a port in the side of the steel junction box before entering the furniture.
- Multiple receptacle units may be installed along the raceway system, in some implementations. These receptacle units may provide either two or four electrical outlets each, plus any fixed number and/or fixed type of telecommunications connectors (e.g., for phones, computers, etc.). These receptacle units may utilize quick-connect couplers and may connected to each other and/or to connectivity couplers in the raceway by quick-connect power conduit jumpers and/or quick-connect communication conduit connectors. The use of quick-connect couplers may increase the ease and/or the speed of installation of a raceway in a location, in some implementations. In some implementations, the use of quick-connect couplers may reduce and/or eliminate the need for tools when coupling receptacles to each other and/or to the raceway. In some implementations, the use of quick-connect couplers may reduce and/or eliminate the need for a licensed technician (e.g., electrician) when coupling receptacles to each other and/or to the raceway.

Other fixed receptacles including, but not limited to: 1) the systems being used as a pass-through only for power and telecommunications cables, 2) the systems being used to accommodate any type of electrical or other cables which directly supply power and/or telecommunications connectivity to the internal cavities of furniture, and/or 3) both ends of the raceway being independent of a building wall or column—in these cases, the raceway may be used to connect one furniture location to another furniture location.

In some implementations, the receptacle may include a modular receptacle. A modular receptacle includes modular components (e.g., sockets). The modular receptacle may include one or more fixed components, in some implementations. For example, a body of a modular receptacle may include one or more openings and/or recesses. Modular components, such as modular connectivity sockets (e.g., power and/or communications connectivity), may be disposed at least partially in the openings and coupled to the modular receptacle. For example, a body of a modular receptacle may include a predetermined number of fixed components (e.g., power sockets and/or communication sockets) and an opening configured to receive one or more modular sockets.

The modular sockets may be coupled to an opening and/or a body (e.g. a body configured to receive the socket) positioned in the modular receptacle using one or more coupling members. The coupling members of the modular socket may allow quick connection of the modular socket to the modular receptacle.

The modular receptacle may include coupling members for coupling the modular receptacle body to the raceway. For example, coupling members such as recesses, grooves, fasteners, pins, locks, and/or any other appropriate coupling member may be utilized to physically couple the modular receptacle to the raceway (e.g., the housing, the connectivity coupler(s), the conduit(s), and/or cable(s)). In some implementations, a receptacle may include first coupling members to couple the housing of the receptacle to the housing of the raceway and second coupling members to couple the sockets of the receptacle to the connectivity couplers and/or cables of the raceway. For example, first coupling members may include protrusion(s) and/or recess(es) that are received by recess(es) and/or protrusion(s) of the housing of the raceway. The second coupling members may include pin and socket connectors (e.g., Molex connector) that allow power and/or communications connectivity to be provided to sockets in the receptacle.

Utilizing modular sockets with the modular receptacle allows the components of the modular receptacle to be changed. For example, when a new connector is available for a device, a new modular socket may replace and/or be added to a modular receptacle such that the device may be coupled to the system. As another example, a modular receptacle may accommodate changes in use of a receptacle. A location previously used to provide power and data connectivity to a laptop may be repurposed such that a television may reside at the location. The modular receptacle that previously may have included a power socket and an Ethernet port may be modified to accommodate the new purpose. For example, an AV socket may be added to the modular receptacle and/or may replace the Ethernet port.

In some implementations, a layout of receptacles at a location may be modified from an existing layout. By utilizing the raceway system, receptacles may be coupled, repositioned, and/or recoupled to the raceway. New receptacles may be added to the raceway and/or old receptacles may be removed from the raceway, as appropriate. The modifications to the raceway system may be obtainable without substantial modification of the existing electrical wiring and/or communications wiring that supplies the raceway since the receptacles couple to the raceway (e.g., as opposed to requiring new dedicated cables to be coupled to each receptacle).

In various implementations, the modular receptacle may have a body and/or coupling members to facilitate connection with a raceway during use. For example, the modular receptacle may be disposed at least partially in the raceway when utilized with a raceway system that resides below flooring and/or disposed above a raceway during use when coupled with a raceway system that resides above flooring.

The modular receptacles may be configured to reside at least partially in an opening of a raceway, couple to a top surface of the cover of the raceway (e.g., such that the receptacle is disposed higher than the top surface of the raceway), and/or have a vertical body that couples to the raceway. Example implementations of these modular receptacles are further described below, by way of non limiting examples:

Example 1

Example 1 illustrates a modular receptacle that is disposed at least partially in the raceway during use. The raceway may have one or more fixed locations at which connectivity may be provided. For example, a raceway may include a plurality of connectivity couplers connected proximate the locations and/or may allow connectivity to a receptacle independent on what is coupled to or not coupled to other connectivity couplers of the raceway.

In various implementations, the raceway systems are designed to provide a method of connectivity for power and telecommunications cabling for any type of furniture or equipment application in interior building spaces. The raceway systems may be low-profile and mount on the floor surface. The raceway systems may allow the required cables to be taken from a vertical building element (e.g., walls, columns, etc.) to the location(s) within the space where the connectivity is needed.

The raceway system may include a raceway (e.g., a central aluminum track) that is installed directly on a floor substrate (e.g., within an interior room or space). For example, the floor substrate may be a structural concrete floor slab. This raceway track may be installed such that it runs approximately perpendicular to a vertical building element (e.g., walls, columns, etc.). Along the top of this raceway is a removable, linear raceway cap, which snaps onto the track and encloses the cabling inside, for example. This cap may also be a walking surface for users of the space. Disposed proximate opposing sides of the linear assembly are low sloping floor transition ramps. These ramps may be included in the raceway system so that the flooring (e.g., carpet, carpet tile, etc.), which is or will be installed on the floor substrate, is able to continue up and over these transition ramps until it reaches and becomes approximately flush with the raceway top cap. The assembly, when installed in this fashion, may appear nearly seamless and/or integrate well with the interior finishes within the space, in some implementations. At the end of this raceway assembly, in some implementations, terminating floor transition ramps allow the flooring to at least partially wrap around the end of the linear raceway system.

The raceway may include cables to provide power and/or communication connectivity. For example, a pre-wired flexible steel conduit may be disposed in an opening of the raceway, such as a cavity formed by a recess in the track. Near the end of the raceway, or at multiple locations along the raceway, receptacles (e.g., modular receptacles) may be disposed proximate the raceway track and anchored in place. For example, the housing of the raceway may include coupling members, such as protrusions and/recesses adapted to couple with coupling members (e.g., protrusions and/or recesses) of the receptacle to dispose a receptacle at a location along a length of a raceway. The sockets of the receptacle may be coupled to the cable (e.g., via coupling the wiring of the receptacle directly to the cables of the raceway and/or via connectivity couplers). These pre-wired cables and/or modular receptacles may allow for ease of installation and/or ease modifications to device placement and/or telecommunications cabling (e.g., types of sockets). When the raceway system top cap is lifted off, in order to access the cable pathway inside, the power conductors themselves may be located within at least one flexible steel conduit allowing safe access to this cavity for adding or changing telecommunications cables, in some implementations.

In various implementations, power and/or communications cabling supplying the modular receptacles may enter the raceway opening proximate a wall or a building column. This cabling may be run vertically through a cavity formed by the wall or column construction or it may be placed inside a vertical, on floor raceway (e.g., reducing the need to penetrate the wall surface). The incoming power supply conduit may couple to the power system of the building, and/or the telecommunications cables couple to the telecommunications panels or equipment of the building (e.g., may be located in a dedicated closet). For example, cables of the raceway may be hardwired to the power supply and/or communication cables at a location, such as a wall of a building and/or via penetrations (e.g., existing penetrations and/or penetrations created for installation of the raceway) in the floor substrate. In some implementations, the floor and/or subfloor may include penetrations that provide access to connectivity sources, such as power cables and/or data cables. The raceway may utilize these existing penetrations by coupling the cable(s) in the raceway to the cables accessible via the penetrations. In some implementations, the cables of the raceway may be plugged into the power supply (e.g., via a power socket) and/or the communications connectivity supply (e.g., via a Ethernet socket and/or fiber optic connector).

Figure 2B:
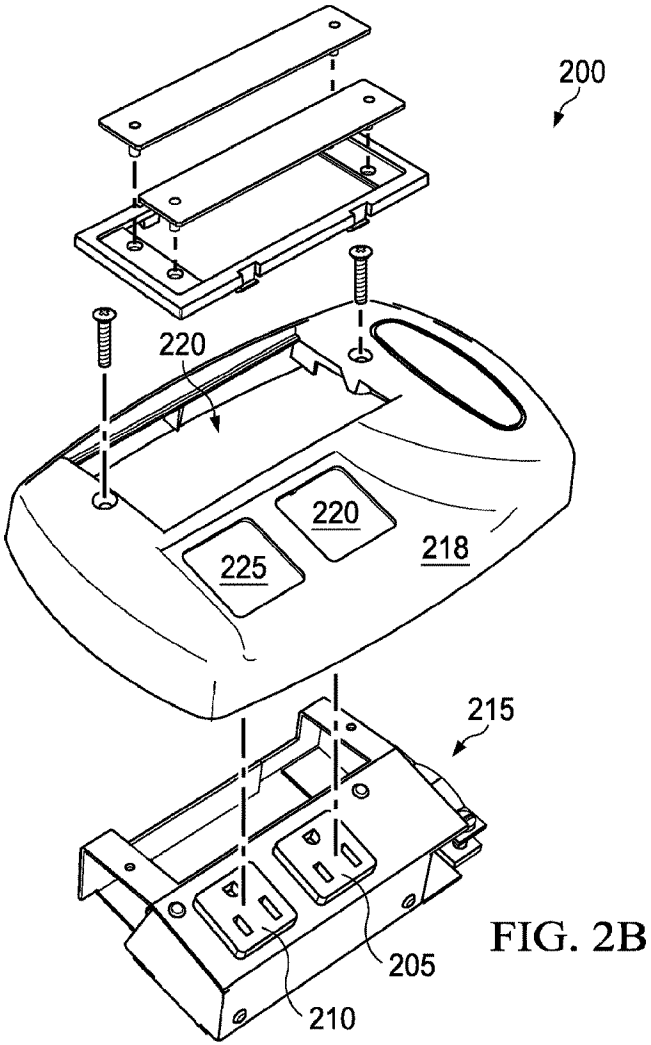
FIG. 2B illustrates an exploded view of an implementation of the example modular receptacle illustrated in FIG. 2A.
Figure 2A:
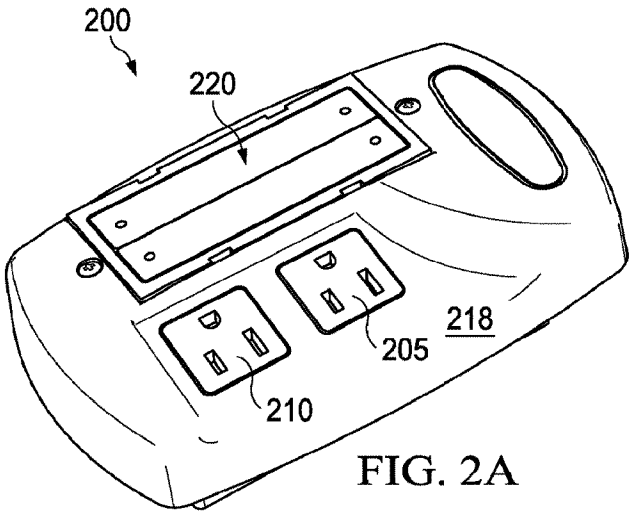
FIG. 2A illustrates an implementation of an example modular receptacle.

FIG. 2A illustrates an implementation of an example modular receptacle 200 adapted to reside at least partially in a raceway. FIG. 2B illustrates an exploded view of an implementation of the example modular receptacle 200 illustrated in FIG. 2A. As illustrated, the modular receptacle is adapted to reside at least partially in an opening of the raceway.

The modular receptacle 200 is provided to accommodate advancements in technology and connectivity methods and/or provide greater flexibility during use. For example, types of sockets that devices coupled to the receptacle may include, but are not limited to: 1) RJ-45/RJ-13/RJ-11-type telephone and computer connectors; 2) Composite video; 3) Component video; 4) Microphone/audio; 5) HDMI; 6) VGA; 7) USB; 8) F-type coax cable connectors; 9) fiber optic connectors; and/or others types of sockets. These sockets may be provided as modular sockets 205 and/or fixed sockets 210 and may be included in the modular receptacle.

The modular receptacle unit may include a housing 215 (e.g., steel unit housing), a flexible steel conduit disposed at least partially in and/or coupled to the housing, and a cover 218 (e.g., plastic cover). As illustrated, the receptacle may include two or more modular receptacles 205 and/or fixed electrical receptacles 210 (e.g., 110 volt; 220 volt; and/or any other appropriate voltage). The cover 218 may include openings 220 in which modular sockets 205 may be disposed and/or coupled to the receptacle. In some implementations, the housing 215 may include opening 205 in which fixed sockets 210 may be disposed. The modular receptacle unit may be disposed inside at least partially in a raceway track or opening in a raceway track and/or may be anchored in place through the track to the floor substrate below or connected to the raceway in any other appropriate manner (e.g., via connectivity couplers, such as Molex connectors).

As illustrated, the modular receptacle may include approximately one half of this unit dedicated to the electrical power connectivity. The approximately other half is designed to accommodate a great variety of the above-described telecommunications connectors as modular sockets, in some implementations. The modular receptacle may be configured to accept these connector devices using multiple connections and/or coupling members.

In some implementations, the modular receptacle may accept a wide variety of "open market" telecommunications modular sockets that are available in multiple sizes and configurations. These individual modular sockets may be easily installed, changed and/or replaced, based at least partially on technology needs and/or location needs.

At the top of approximately half of the receptacle cover is a rectangular opening approximately 3.875" long and approximately 2.75" wide. Along the long sides of this opening is a feature, which allows telecommunications modules to easily "snap" into place. The dimensions of this opening, as illustrated, are such that it accommodates four (4) modular telecommunications device modules or plates that are 1-unit long. The "open market" telecommunication modules or plates for which this receptacle cover is designed may be either 1-Unit long or 1.5 units long. Thus, a total of two (2) 1.5 unit and one (1) 1-unit modules may be accommodated together in this opening. In some implementations, up to four (4) 1-unit modules may be accommodated, or any combination of these may be used. Although specific dimensions are described, any appropriate dimension of the receptacle and/or portions there of may be utilized as appropriate. For example, the receptacle may accommodate 7 modular sockets.

In some implementations, the modular receptacle may include a cover. In some implementations, blank or filler modular sockets may be used in place of a specific modular socket in order to close the opening in the modular receptacle.

In some implementations, a rectangular plastic adapter plate may be attached to the top of this rectangular opening. Proprietary telecommunications connector plates may be attached to the plastic adapter plate with screws, bolts and/or other fasteners.

In various implementations, the modular receptacle may be installed as follows: Incoming telecommunications cables and/or power cables are terminated with the appropriate telecommunications connectors (e.g. RJ-45s, HDMI, VGA, etc.) and/or power connectors; these connectors are snapped into the matching, empty telecommunications modules or plates (e.g., in the opening of the modular receptacle). The modular sockets are then snapped into the rectangular opening in the top of the plastic receptacle cover. Finally, the entire cover assembly is coupled (e.g., screwed, fastened, and/or otherwise affixed) into place atop the steel receptacle unit of the raceway. The modular receptacle may include a coupling member (e.g., fastener, opening, groove, and/or recess) to facilitate coupling with the raceway system.

Example 2

Example 2 illustrates a modular receptacle that is coupled to the raceway and is disposed above the raceway during use. The raceway may have one or more fixed locations at which connectivity may be provided. For example, a raceway may include a plurality of connectivity couplers connected proximate the locations and/or may allow connectivity to a receptacle independent of what is coupled to or not coupled to other connectivity couplers of the raceway.

Figure 3A:
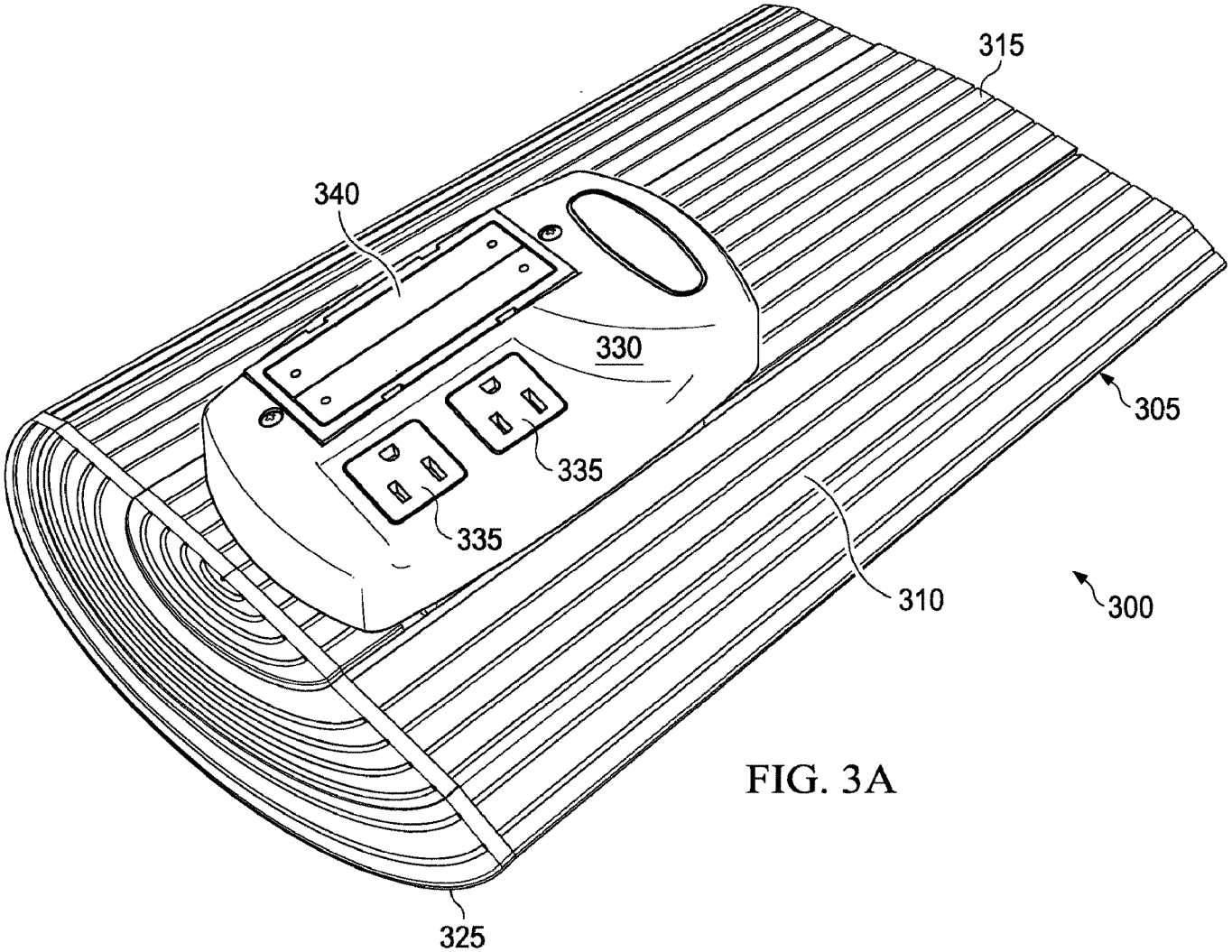
FIG. 3A illustrates an implementation of an example modular receptacle in a raceway system.
Figure 3B:
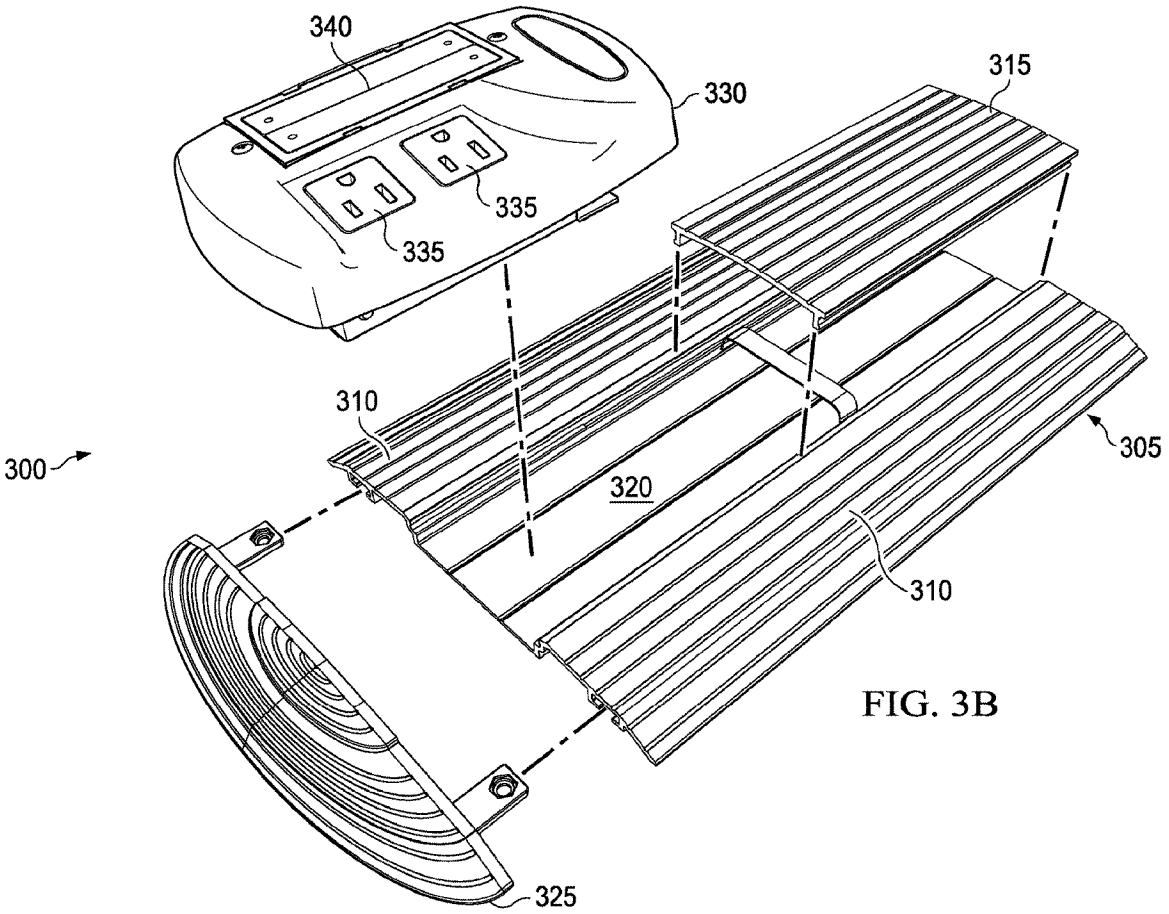
FIG. 3B illustrates an exploded view of an implementation of the example modular receptacle in a raceway system illustrated in FIG. 3A.

FIG. 3A illustrates an implementation of an example modular receptacle in a raceway system 300. FIG. 3B illustrates an exploded view of an implementation of the example modular receptacle in the raceway system 300 illustrated in FIG. 3A.

As illustrated, the modular receptacle may allow a connectivity for interior and/or exterior applications which would may be easily, quickly and/or economically installed on top of existing flooring (e.g., as opposed to disposed in an opening of the raceway). The raceway may extend from a penetration in a floor substrate (e.g., existing and/or formed for installation of a raceway); a wall, column or other interior vertical architectural feature along a floor to any type of furniture or equipment application inside a building, for example. These on floor raceways (e.g., mounted on top of existing flooring) may be easily installed in any location within a building, before and/or after occupancy, with little if any disruption to the occupants. The on floor raceways may be utilized as permanent and/or temporary connectivity devices.

The on floor raceway system 300 may include a housing 305, such as a central extruded aluminum track or trough, flanked on both sides by low-sloping sides 310, such as integral aluminum ramps. Raceway 300 may be a on floor raceway and may be installed on a floor surface. One end of this base component of the raceway may be located at a vertical building element (e.g., a wall, column, etc.), in some implementations. The base component may extend out from the wall or column to the location where the connectivity need exists (e.g., power and/or telecommunications). Disposed along the top of this base component of the raceway is a removable, linear raceway cover 315 which may snap or otherwise couple onto the housing 305 forming a raceway and/or cavity. The cavity 320 may include a cable pathway (e.g., a channel of the raceway) which accommodates power and/or telecommunications wires and cables. The end of this raceway may include an end component 325, which caps the end of the cable pathway and side ramp portions of the base component. In some implementations, pre-wired flexible steel conduit that provides power and/or communication connectivity may be disposed in the cavity 320 of the raceway. For example, a fiber optic cable and/or a CAT 6 cable may be utilized. In some implementations, a single cable may provide power and communication connectivity (e.g., to a connectivity coupler). At one or more locations (e.g., along a length of the raceway and/or cable), receptacles 330 (e.g., modular receptacles) are placed in the raceway cavity 320 (e.g., track or trough) and coupled (e.g., anchored) in place. These pre-wired cables, modular receptacles 330, and the raceway systems 300 may allow for ease of installation and/or ease of modification to receptacle placement and/or changes to the telecommunications cabling.

When cover 315 of the on floor raceway 100 is lifted off in order to access the cavity and/or the cable pathway inside the cavity, the power conductors themselves may be disposed at least partially within their steel conduit allowing safe access to this cavity for adding and/or changing telecommunications cables. In some implementations, the connectivity coupler may be accessed once a cover is removed.

Power and telecommunications cabling supplying the devices may enter the cavity 320 of the raceway proximate a wall or building column. This cabling may be run vertically through a cavity formed by the wall or column construction and/or it may be placed inside a vertical, surface-mounted raceway obviating the need to penetrate the wall surface. The vertical surface-mounted raceway may extend upwards from the floor to the ceiling plenum above, or may end at a on floor junction box located on the wall surface. The incoming power supply conduit may attach to the power system of the building (e.g., via hardwire coupling and/or via a plug), and the telecommunications cables may connect to the telecommunications panels or equipment. Access to tower and/or telecom cables may also be provided to the raceway by coupling the cable(s) to the tower and/or telecom cables (e.g., via a penetration in a floor). For example, connectivity plug(s) may extend from a housing of the raceway to be coupled to connectivity sources. The connectivity plug may include a power plug, a data plug, and/or a plug (e.g., CAT5 and/or CAT6) that allows data and power to be provided through the same plug. The connectivity plug(s) may be coupled to the connectivity source via a socket, plug or other coupling member connected to the connectivity source (e.g., CAT5 port, power socket, etc.).

The modular receptacle 330 may include fixed socket(s) 335 and/or opening(s) 340 adapted to receive modular sockets.

The modular receptacles may be coupled to the on floor raceway system, in a variety of ways, such as, but not limited to:

A single modular receptacle unit may be installed at or proximate the end of the on floor raceway (e.g., opposite the wall or column). This device may provide fixed and/or modular sockets. For example, the modular receptacle may include a fixed number of communication and/or power sockets (e.g., two or four electrical outlets) and an opening configured to receive a variable number (e.g., the number may be based on the size of modular sockets selected) and/or types of telecommunications modular sockets (e.g., for phones, computers, etc.) and/or power sockets. This receptacle unit is hard-wired to an incoming flexible steel power conduit, which is part of a complete system. In some implementations, the receptacle unit may couple to the raceway via a connectivity coupler of the raceway system. For example, the receptacle unit may include a coupling member adapted to be couple with the connectivity coupler of the raceway system to provide connectivity (e.g., power and/or communications) that may be provided to devices coupled to the socket of the receptacle. In some implementations, the receptacle unit may include coupling member(s) to couple a housing of the receptacle to at least a portion of the housing (e.g., via recess(es) and/or protrusion(s)).

A single junction box modular receptacle unit may be installed at or near the end of the on floor raceway and/or several single junction box modular receptacle units may be installed along a length of the raceway. This junction box may be hard-wired to the incoming flexible steel power conduit and/or coupled via a connectivity coupler of the raceway. Furniture system(s) and/or equipment power conduit(s) may be hard-wired to this junction box. For example, several furniture systems, such as bench or desk systems may be coupled to the raceway. Each bench or desk system may be coupled to the raceway via a receptacle, in some implementations. In addition, telecommunications cables, which pass through the raceway, may exit via a port in a side of the steel junction box before entering the furniture.

Multiple modular receptacle units may be installed along the on floor raceway system. These modular receptacle units utilize quick-connect couplers and/or may be connected to each other by quick-connect power conduit jumpers, which may be quick and easy to install.

There are many other methods of using the on floor raceway systems and/or surface-mounted raceway system including, but not limited to: 1) the systems being used as a pass-through for power and telecommunications cables, and 2) the systems being used to accommodate any type of electrical or other cables which directly supply power and/or telecommunications connectivity to the internal cavities of furniture, and/or 3) both ends of the raceway being independent of a building wall or column (e.g., in these cases, the raceway may be used to connect one furniture location to another furniture location).

Example 3

Example 3 describes a modular receptacle that includes a vertical body. The vertical body modular receptacle may be coupled to raceway systems in which the raceway is disposed under flooring and/or on top of flooring, as previously described. The raceway may have one or more fixed locations at which connectivity may be provided. For example, a raceway may include a plurality of connectivity couplers connected proximate the locations and/or may allow connectivity to a receptacle independent on what is coupled to or not coupled to other connectivity couplers of the raceway.

Figure 4A:
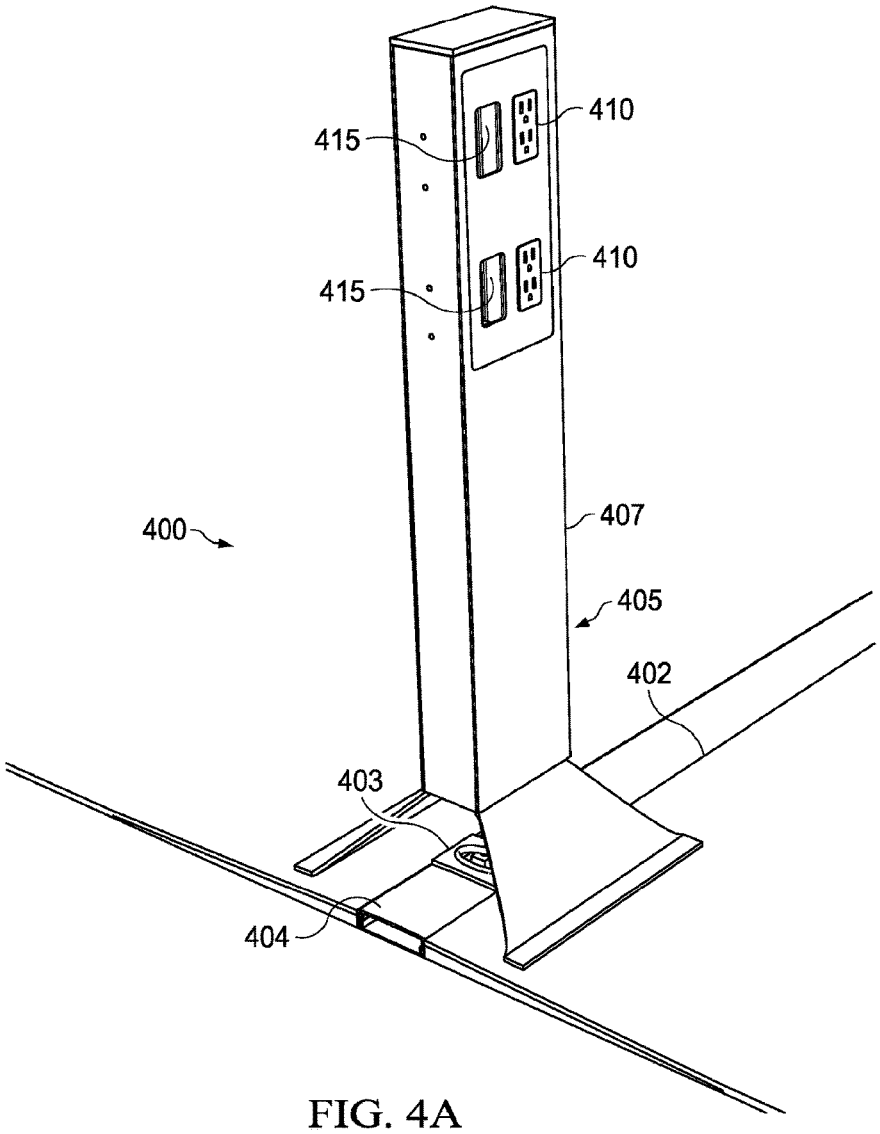
FIG. 4A illustrates an implementation of an example modular receptacle in a raceway.
Figure 4B:
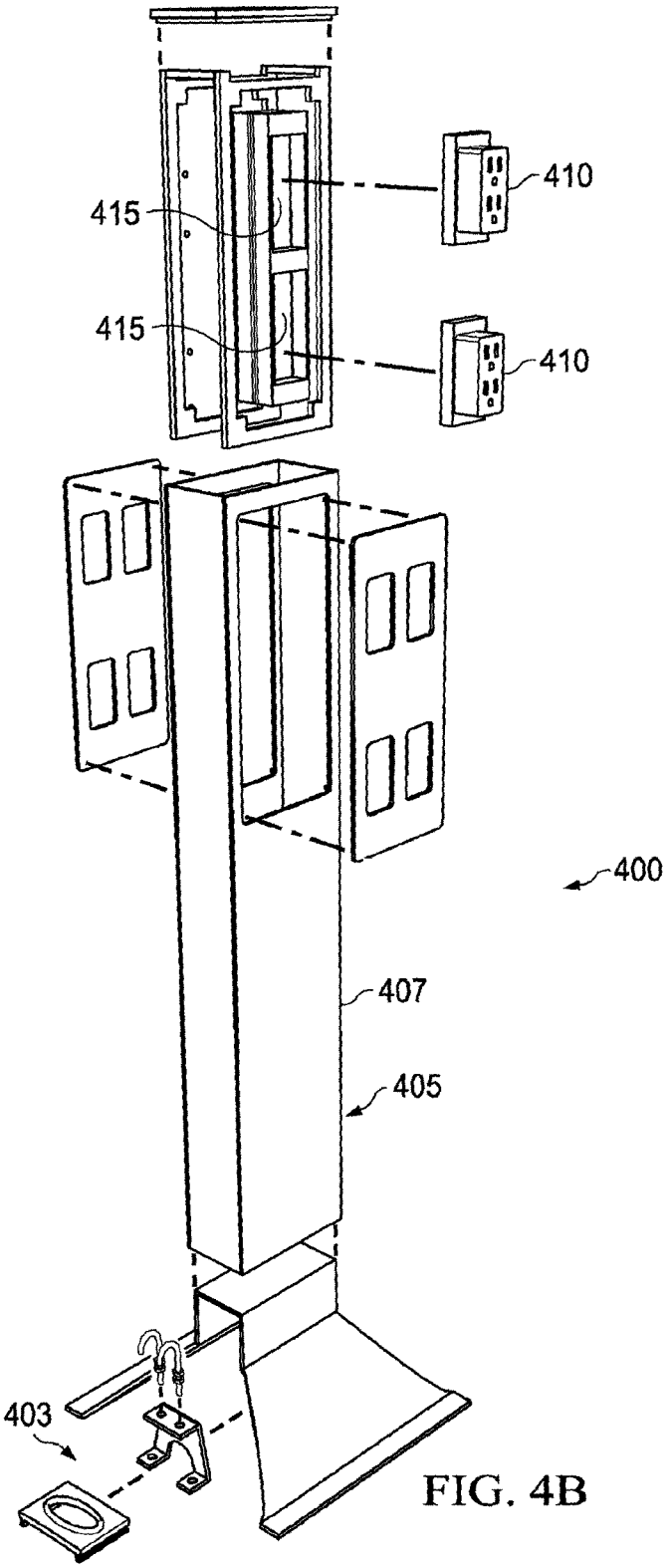
FIG. 4B illustrates an exploded view of an implementation of the example modular receptacle illustrated in FIG. 4A.

FIG. 4A illustrates an implementation of an example modular receptacle in a raceway 400. FIG. 4B illustrates an exploded view of an implementation of the example modular receptacle 405 illustrated in FIG. 4A. A raceway 400 may include a housing 402 and a cover 404 disposed above at least a portion of the cavity in the housing 402. The raceway may include more than one connectivity couplers at two or more fixed location(s) along a length of the raceway.

The modular receptacle 405 that includes a vertical body or tower modular receptacle may be a vertical connectivity device. The tower 405 may include a height, a length, and a width. The tower may include fixed and/or modular sockets 410. The modular sockets 410 may be disposed in openings 415 in the housing 407 of the tower 405. The tower 405 may couple to a raceway 400 via a connectivity coupler and a coupling member 403 that couples with a housing 402 of the raceway. For example, the vertical body may be approximately 36" high and may provide electrical power sockets and telecommunications sockets, for example, at approximately tabletop height and/or at other heights. The tower modular receptacle can be installed singularly or in multiples. The tower modular receptacle may be utilized with raceway systems, such as on floor raceway systems previously described.

A tower modular receptacle may provide power and/or telecommunications connectivity from the floor level up to approximately tabletop height. For example, tower modular receptacles may be utilized in libraries, offices, reception and waiting areas, airport lobbies, etc. The tower modular receptacle may have quick and easy installation, and may allow for flexibility as needed (e.g., flexibility of number and/or type of sockets and/or flexibility of arrangement of a plurality of towers). For example, in these interior spaces, users (e.g., employees, members of the public, etc.) may need to be able to "plug-in" or otherwise connect devices such as laptop computers, tablet computers, cell phone charges, music players, etc. The tower modular receptacle may facilitate connectivity for multiple users.

Often in locations, the receptacles and telecom ports are often at or near floor level. To provide access at a higher elevation, the tower modular receptacle may be utilized. For example, the tower modular receptacle may include one or more sockets (e.g., modular and/or fixed) proximate the height of a typical table or work surface (e.g., approximately 30" above the floor level) and/or sockets (e.g., fixed and/or modular) proximate the height of a chair or other seating (e.g., approximately 20" above the floor).

The tower modular receptacle may couple to floor-mounted raceways, for flexibility and ease of installation, for example. These raceway systems are low profile and mount on the floor surface of a space or room. They allow the required cables to be taken from a vertical building element (walls, columns, etc.) to the location(s) within the space where the connectivity is needed. Coupling the tower modular receptacle with the floor-mounted raceway systems may allow a connectivity device that can provide flexible and an easy installation solution for locations such as modern collaborative workspaces, libraries, etc.

The tower modular receptacle may include a base, a tower shaft, face plates, top cap, and/or modular sockets (e.g., modular power sockets and/or communication sockets).

The base of the tower modular receptacle may provide stability to the towers after installation and/or may inhibit movement of a tower (e.g., falling and/or other movement away from a specified location). The base may be coupled to the floor substrate by anchoring through the base itself into the floor substrate (e.g., through the finish flooring material, if present). The base may be installed via connection to a coupling member, such as a bracket, located within the raceway. The base may be coupled to the raceway utilizing other appropriate coupling members.

The tower shaft of the tower modular receptacle may couple to the base. The cables and/or sockets of the tower modular receptacle may be at least partially disposed in the tower shaft. Other devices and/or equipment may be housed in the tower shaft.

The face plates of the tower modular receptacle may be disposed proximate the top of the towers, may be removable, and/or may allow access for installing the power and communications sockets and/or for making changes to the sockets as needed.

The top cap of the tower modular receptacle may include a decorative cap, which finishes the exterior tower assembly. The top cap may include of a variety of materials and finishes and in various designs.

Modular power sockets may be disposed in the tower modular receptacle. These modular power sockets may provide quick and easy installation, ease of modification to the power components, and/or to provide safe and adequate electrical power, for example, 110 Volt and/or 15-Amp, for users. The modular power sockets minimize the need and expense of manually installing and connecting loose power conduits, electrical receptacles, etc. The modular power sockets may include a power "block" which has quick-connect components on both the top and bottom ends. Incoming quick-connect power supply cables and/or outgoing quick-connect power cables may be coupled to the block to supply additional tower modular receptacles when installed in multiples, or in a series. These blocks may include openings, dispose in a side of the tower modular receptacle, in which modular power sockets can be snapped, clipped, and/or otherwise coupled into the tower modular receptacle. The blocks may be coupled to an interior wall surface of the tower shaft. Complete installation of the modular power sockets may be quick (e.g. complete in minutes).

Modular communication sockets (e.g., telecommunication sockets) may be disposed in a tower modular receptacle. The tower modular receptacle may be able to couple with a wide variety of "open market" telecommunications modular sockets that are available in multiple sizes and configurations. These individual modular sockets may be easily installed, changed and/or replaced based on technology needs and/or location needs.

In some implementations, the tower modular receptacle may include face plates that include rectangular openings approximately 2.91" long and approximately 1.75" wide and which may be designed to accommodate telecommunications sockets and devices. The long sides of an opening may include a feature, which allows telecommunications modules to easily "snap" or otherwise couple into the tower modular receptacle. The dimensions of the openings may be selected such to accommodate a predetermined number (e.g., 3) modular telecommunications sockets and/or plates that are 1-unit long. The "open market" telecommunication modular sockets or plates may be approximately 1-Unit long or 1.5 units long. Thus, a total of two 1.5 unit sockets and/or plates or up to three 1 unit long sockets and/or plates may be disposed in a tower modular receptacle opening, for example. In some implementations, blank and/or filler modules may be used to close and/or cover openings that remain when a number of sockets less than a maximum amount that can be positioned in an opening is used in the tower modular receptacle.

In some implementations, the tower modular receptacles may be coupled to floor-mounted raceways which were previously installed. Power and communications cables disposed in the raceway track may be provided and/or coupled to the tower. The cables may be provided into at least a portion of a cavity inside a tower modular receptacle, in some implementations. The power cables may snap or otherwise couple into place on the blocks, and the telecommunications cables may be terminated in their respective sockets, which may be snapped into the tower face plates. The towers may be anchored or otherwise coupled into a location along the raceway.

In some implementations, tower modular receptacles may be coupled via hardwire to existing or new "core-drill" or other recessed devices installed in a floor of a structure, such as a concrete structural slab. The tower bases may be anchored or otherwise coupled to the floor structure.

In some implementations, the tower modular receptacle(s) may be coupled to incoming quick-connect and/or other power supply cables placed beneath a raised access floor system. The tower bases may be anchored and/or otherwise coupled to the surface of the raised access floor system.

In some implementations, the tower modular receptacle(s) may be "soft-corded" or plugged into an existing power receptacle at the floor level. The tower modular receptacle may be used as a temporary connectivity device (e.g., disaster relief, outdoor venues, conferences, etc.).

Example 4

Example 4 illustrates an implementation of an adaptable raceway. The raceway may include a housing with a bottom surface and an opposing top surface. The bottom surface of the housing may reside, when installed, on a top surface of a subfloor and/or flooring. For example, the bottom surface of the housing may reside and/or be coupled to a wooden and/or concrete subfloor in a building. The bottom surface may reside and/or be coupled to a top surface of the flooring of an outdoor area, such as the ground, pavers, walkways, patios, etc. When the raceway is installed such that a top surface extends at a height above a top surface of the flooring, the sides of the raceway may be slanted (e.g., to facilitate rolling equipment over raceway and/or to inhibit tripping).

The raceway may include cables (e.g., in and/or not in a conduit) that are disposed in a cavity and/or covered at least partially by cover(s) disposed over at least a portion of the cavity. The cables may transmit connectivity (e.g., power and/or data) provided by a connectivity source when the cables are coupled via a connectivity coupling member to a connectivity source. For example, a connectivity plug may extend from a housing and plug into a connectivity source (e.g., a socket coupled to a connectivity source). In some implementations, the connectivity source member may include wiring and/or a portion of the cable that may be hard-wired to the connectivity source.

The raceway may include a plurality of connectivity coupling members. For example, the cables may include and/or be coupled to connectivity coupling members disposed along a length of the cable(s) and/or length of the raceway. The connectivity members may provide connectivity from cables to receptacle(s), when the receptacle(s) are coupled to the connectivity member(s). One or more of the connectivity members may be able to operate (e.g., provide connectivity) independently of the other connectivity members on the raceway. For example, a connectivity coupler may be allowed to provide connectivity to receptacle(s) coupled to the connectivity coupler when one or more of the other connectivity couplers are coupled to other receptacles and/or when one or more of the other connectivity couplers are not coupled to other receptacles.

The connectivity couplers may include a first connectivity coupler, a second connectivity coupler, a third connectivity coupler, and a fourth connectivity coupler positioned at fixed locations across a length of the raceway. The first connectivity coupler may be disposed at a first position, the second connectivity coupler may be disposed at a second position, the third connectivity coupler may be disposed at a third position, and the fourth connectivity coupler may be disposed at a fourth position. The first position may be directly coupled to the connectivity source. For example, the first connectivity coupler may be directly connected to the connectivity source via the cable (e.g., as opposed to being coupled to another connectivity coupler which is disposed to another connectivity coupler and/or a connectivity source). The second position may be disposed between the first position and the third position and the fourth position may be disposed between the third position and the fifth position.

When the first connectivity coupler, the second connectivity coupler, and fourth connectivity coupler may not be coupled to a first receptacle, second receptacle, and fourth receptacle respectively. A third receptacle may be coupled to a third receptacle. The third receptacle may be allowed to provide connectivity even when the other connectivity sources are not coupled to receptacles.

In some implementations, the first receptacle, the second receptacle, the third receptacle, and/or other receptacles coupled to the raceway may be similar and/or dissimilar For example, the first receptacle, the second receptacle, and/or the third receptacle may include fixed receptacles and/or modular receptacles. Some receptacles may be hard-wired to the raceway and other receptacles may be otherwise coupled to the raceway. In some implementations, the receptacles may each be coupled to the raceway using similar coupling methods and/or coupling members. In some implementations, the first receptacle, the second receptacle, and/or the third receptacle may include similar and/or dissimilar types of receptacles, sizes of receptacles, socket types, socket sizes, and/or number of sockets.

Example 5

Example 4 illustrates an implementation of an adaptable raceway. The raceway may include a housing with a bottom surface and an opposing top surface. The bottom surface of the housing may reside, when installed, on a top surface of a subfloor and/or flooring. For example, the bottom surface of the housing may reside and/or be coupled to a wooden and/or concrete subfloor in a building. The bottom surface may reside and/or be coupled to a top surface of the flooring of an outdoor area, such as the ground, pavers, walkways, patios, etc. When the raceway is installed such that a top surface extends at a height above a top surface of the flooring, the sides of the raceway may be slanted (e.g., to facilitate rolling equipment over raceway and/or to inhibit tripping).

The raceway may include cables (e.g., in and/or not in a conduit) that are disposed in a cavity and/or covered at least partially by cover(s) disposed over at least a portion of the cavity. The cables may transmit connectivity (e.g., power and/or data) provided by a connectivity source when the cables are coupled via connectivity plug(s) to a connectivity source. For example, connectivity plug(s) may extend from a housing and plug into a connectivity source (e.g., a socket coupled to a connectivity source). The connectivity plug(s) may include a power plug and a fiber optic plug.

The raceway may include a plurality of connectivity coupling members. For example, the cables may include and/or be coupled to connectivity coupling members disposed along a length of the cable(s) and/or length of the raceway. The connectivity members may provide connectivity from cables to receptacle(s), when the receptacle(s) are coupled to the connectivity member(s).

End of Examples

Although Examples 1-3 describes specific implementations of systems and processes, other implementations may be utilized as appropriate. One or more features of Examples 1-3 may be modified to include one or more features of other described processes, such as those described in Examples 1-3. In addition, various features may be added, deleted, and/or modified.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a modular communications socket" includes a combination of two or more modular communications socket and reference to "a modular receptacle" includes different types and/or combinations of modular receptacles. A "raceway" includes different types and/or combinations of raceways. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A raceway, disposable on a floor, to provide connectivity, the raceway comprising:

a housing comprising:

a first side configured to contact the floor; and a second opposing side, wherein the second opposing side comprises a cavity disposed in the second side of the housing;

one or more cables disposed in the cavity and adapted to provide connectivity when coupled to a connectivity source, wherein the one or more cables comprises a first section of cable and second section of cable; and two or more connectivity couplers coupled to at least one of the cables, wherein each of the connectivity couplers is capable of coupling with at least one receptacle such that connectivity provided to the connectivity coupler is provided to the at least one coupled receptacle, and wherein the at least one receptacle comprises one or more sockets capable of receiving one or more plugs of one or more devices; and wherein at least one of the connectivity couplers comprises a first connectivity coupler; and wherein the first section of cable directly couples the connectivity source to the first connectivity coupler; and wherein at least one of the connectivity couplers comprises a second connectivity coupler; and wherein the second section of cable extends between the first connectivity coupler and the second connectivity coupler, and wherein the second connectivity coupler is not directly coupled to the connectivity source; and wherein the raceway allows the second connectivity coupler to provide connectivity to one or more of the at least one receptacle coupled to the second connectivity coupler when the first connectivity coupler is coupled to one or more other receptacles of the at least one receptacles and when the first connectivity coupler is not coupled to the one or more other receptacles of the at least one receptacles.

2. The raceway of claim 1 further comprising one or more covers disposed over at least a portion of the housing.

3. The raceway of claim 1 further comprising:

one or more third connectivity couplers capable of providing connectivity to one or more third receptacles of the at least one receptacles when coupled to at least one of the third connectivity couplers, and wherein a third section of cable extends between at least one of the third connectivity couplers and at least one of the first connectivity coupler or the second connectivity coupler; and wherein the raceway is adapted to allow one or more of the third connectivity couplers to provide connectivity to the one or more of coupled third receptacles when:

the first connectivity coupler is coupled to the one or more other receptacles of the at least one receptacles, and when the first connectivity coupler is not coupled to the one or more other receptacles, and when the second connectivity coupler is coupled to the one or more receptacles, and when the second connectivity coupler is not coupled to the one or more receptacles.

4. The raceway of claim 1 wherein the first connectivity coupler is disposed at a first position proximate a connectivity coupling member on the raceway; and wherein the second connectivity coupler is disposed at a second position along a length of the raceway;

and further comprising:

a third connectivity coupler capable of providing connectivity to one or more third receptacles of the at least one receptacles coupled to the third connectivity coupler, wherein the third connectivity coupler is disposed at a third position along the length of the raceway, and wherein the second position is disposed between the first position and the third position; and wherein the raceway is adapted to allow the third connectivity coupler to provide connectivity to one or more of the third receptacles coupled to the third connectivity coupler when at least one of:

the first connectivity coupler is not coupled to at least one of the first receptacles;

or the second connectivity coupler is not coupled to at least one of the second receptacles.

5. The raceway of claim 1 further comprising at least one cable adapted to provide electrical connectivity and communications connectivity.

6. The raceway of claim 1 further comprising one or more conduits at least partially disposed in the cavity of the housing, wherein one or more of the cables are at least partially disposed in at least one of the conduits.

7. The raceway of claim 1 wherein the second connectivity coupler comprises a first coupling member; and wherein at least one of the second receptacles comprises a second coupling member; and wherein the first coupling member of the second connectivity coupler couples to the second coupler of at least one of the second receptacles to couple the second connectivity coupler to at least one of the second receptacles.

8. The raceway of claim 1 wherein the housing comprises a cable coupling member adapted to retain at least one cable in the housing.

9. The raceway of claim 1 further comprising an electrical power plug extending from the housing and adapted to couple to a power source, wherein at least one of the cables is coupled to the electrical power plug.

10. The raceway of claim 1 further comprising a communication plug extending from the housing and adapted to couple to a communications connectivity source, wherein at least one of the cables is coupled to the communication connectivity plug.

11. The raceway of claim 1 wherein at least one of the connectivity couplers is coupled to more than one cable.

12. The raceway of claim 1 further comprising one or more receptacles adapted to couple to one or more of the connectivity couplers.

13. A method of providing connectivity, the method comprising:

coupling one or more cables disposed in a cavity of a first side of a raceway to two or more connectivity sources; wherein the raceway comprises two or more connectivity couplers to provide connectivity to one or more receptacles coupled to at least one of the connectivity couplers; wherein at least two of the connectivity couplers comprise:

a first connectivity coupler, wherein a first section of the one or more cables directly couples the first connectivity coupler to a connectivity source; and a second connectivity coupler, wherein a second section of the one or more cables extends between the first connectivity coupler and the second connectivity coupler, and wherein the second connectivity coupler is not directly coupled to the connectivity source; and providing connectivity to a second receptacle coupled to the second connectivity coupler when the first connectivity coupler is coupled to one or more other receptacles and when the first connectivity coupler is not coupled to the one or more other receptacles.

14. The method of claim 13 further comprising:

removing a cover of the raceway such that access to a first portion of the cavity of a housing of the raceway is allowed; and coupling a third receptacle to at least one of the connectivity couplers accessible through the first portion of the cavity.

15. The method of claim 13 further comprising:

uncoupling the second receptacle coupled to the second connectivity coupler of the raceway; and disposing a cover over the second connectivity coupler.

16. The method of claim 13 wherein one or more of the connectivity couplers comprise one or more third connectivity couplers, and further comprising:

providing connectivity to one or more third receptacles by coupling at least one of the third receptacles to at least one of the third connectivity couplers; and allowing at least one of the third connectivity couplers to provide connectivity to one or more of the third receptacles coupled to at least one of the third connectivity couplers when at least one of:

the first connectivity coupler is not coupled to the one or more other receptacles;

or the second connectivity coupler is not coupled to at least one of the first second receptacles.

17. The method of claim 13 further comprising coupling the raceway to the connectivity source via a connectivity source member extending from the housing of the raceway and coupled to one or more cables of the raceway.

18. The raceway of claim 1 wherein the floor comprises a subfloor.

19. The raceway of claim 1 further comprising one or more ramps disposed proximate the housing of the raceway.

20. The raceway of claim 1 wherein at least one of the cables is connected to the connectivity source via a penetration in at least one of the floor or subfloor.

* * * * *